US007571835B2

(12) United States Patent
Hill et al.

(10) Patent No.: US 7,571,835 B2
(45) Date of Patent: Aug. 11, 2009

(54) BAG-IN-BOX BEVERAGE CONTAINER

(75) Inventors: Webb LeRon Hill, Toledo, OH (US); Karen M. Chiera, Elmhurst, IL (US); Robert James Crosland, La Mirada, CA (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 548 days.

(21) Appl. No.: 11/318,304

(22) Filed: Dec. 23, 2005

(65) Prior Publication Data

US 2006/0097005 A1 May 11, 2006

Related U.S. Application Data

(63) Continuation-in-part of application No. 10/293,878, filed on Nov. 13, 2002, now Pat. No. 7,007,825.

(51) Int. Cl.
*B65D 35/22* (2006.01)

(52) U.S. Cl. ..... 222/94; 222/105; 229/117.36; 229/120.11; 229/120.18

(58) Field of Classification Search ..... 222/183, 222/184, 185.1, 105, 94; 229/117.35, 120.11, 229/120.18

See application file for complete search history.

(56) References Cited

U.S. PATENT DOCUMENTS 181,014 A * 8/1876 Scott ..... 222/466
1,046,945 A * 12/1912 Bauer et al. ..... 229/186
1,088,964 A * 3/1914 Buchman ..... 229/125.42
2,574,931 A * 11/1951 Nason, Jr. ..... 222/105
2,618,409 A * 11/1952 Eisenberger et al. ..... 222/95
2,831,610 A * 4/1958 Dennie ..... 222/105
2,954,901 A * 10/1960 Winstead ..... 222/183
3,054,549 A * 9/1962 Humphrey ..... 229/117.3
3,078,018 A * 2/1963 Galloway ..... 222/183
3,081,911 A * 3/1963 Scholle ..... 222/107
3,087,655 A * 4/1963 Scholle ..... 222/183
3,090,526 A * 5/1963 Hamilton et al ..... 222/105

(Continued)

FOREIGN PATENT DOCUMENTS

DE 2908654 A1 9/1980

(Continued)

OTHER PUBLICATIONS

Picture of "Java Box" 1-gallon disposable dispenser as shown at http://www.bibpak.com/Java Box/javabox.html, at least as early as Nov. 13, 2001.

(Continued)

*Primary Examiner*—Kevin P Shaver
*Assistant Examiner*—Andrew P Bainbridge
(74) *Attorney, Agent, or Firm*—Armstrong Teasdale LLP

(57) ABSTRACT

A bag-in-box beverage container and dispenser is provided, incorporating an outer shell fabricated preferably from corrugated paperboard material, and a plurality inner liquid containing bags, fabricated from a suitable plastic material. The carton includes ready assembly features, as well as at least one internal ramp structure for prompting flow of liquid toward a plurality of dispensing apertures disposed in the outer shell. A recessed handle structure is also provided, as are alternative embodiments of the internal ramp structure.

18 Claims, 20 Drawing Sheets

U.S. PATENT DOCUMENTS 3,108,732 A * 10/1963 Curie et al. ..... 229/117.3
3,117,695 A * 1/1964 Cox, Jr. ..... 222/105
3,119,544 A * 1/1964 Cope et al. ..... 229/117.16
3,123,254 A * 3/1964 Rabby et al. ..... 222/105
3,132,789 A * 5/1964 Forrest ..... 229/117.3
3,143,249 A * 8/1964 Merrill et al. ..... 222/105
3,160,326 A * 12/1964 Sturdevant et al. ..... 222/183
3,163,326 A 12/1964 Valyi
3,163,544 A * 12/1964 Valyi ..... 426/112
3,169,690 A * 2/1965 Scholle ..... 229/117.3
3,173,579 A * 3/1965 Curie et al. ..... 222/105
3,194,480 A * 7/1965 Maindron ..... 229/117.15
3,221,943 A * 12/1965 Anderson ..... 222/183
3,226,002 A * 12/1965 Walker ..... 229/117.3
3,227,322 A * 1/1966 Crain ..... 222/183
3,233,817 A * 2/1966 Casady ..... 229/117.3
3,255,950 A * 6/1966 Marcouly et al. ..... 229/117.13
3,349,986 A * 10/1967 Chapman et al ..... 229/117.3
3,363,807 A * 1/1968 Powell ..... 222/105
3,427,646 A * 2/1969 Scholle ..... 53/281
3,931,916 A * 1/1976 Blue et al. ..... 222/465.1
3,952,940 A * 4/1976 Malcolm ..... 229/117.31
4,174,051 A * 11/1979 Edwards et al. ..... 222/105
4,375,864 A * 3/1983 Savage ..... 222/81
4,572,422 A * 2/1986 Heuberger et al. ..... 229/117.3
4,653,671 A * 3/1987 Duffy et al. ..... 222/105
4,673,125 A * 6/1987 Weaver ..... 229/122.2
4,781,314 A * 11/1988 Schoonover et al. ..... 222/465.1
4,815,631 A * 3/1989 Eeg et al. ..... 229/117.3
4,836,416 A * 6/1989 Shalgi et al. ..... 222/48
4,850,509 A * 7/1989 Hollenberg ..... 206/205
4,934,654 A * 6/1990 Linnemann ..... 251/144
5,037,002 A * 8/1991 Tschanen ..... 222/105
5,042,682 A * 8/1991 Ritter et al. ..... 229/117.3
5,048,691 A * 9/1991 Heuberger et al. ..... 229/117.3
5,050,775 A * 9/1991 Marquardt ..... 222/93
5,125,566 A * 6/1992 Deiger ..... 229/125.15
5,147,062 A * 9/1992 Heuberger et al. ..... 229/117.27
5,147,071 A * 9/1992 Rutter et al. ..... 222/92
5,156,295 A * 10/1992 Gordon et al. ..... 229/117.35
5,163,485 A * 11/1992 Hermann ..... 141/10
5,176,313 A * 1/1993 Curry et al. ..... 229/125.15
5,186,359 A * 2/1993 Brown et al. ..... 222/1
5,201,462 A * 4/1993 Sada et al. ..... 229/125.15
5,335,829 A * 8/1994 Sovann ..... 222/183
5,392,958 A * 2/1995 Kurtzahn et al. ..... 222/105
5,715,992 A * 2/1998 Andrews et al. ..... 229/125.15
5,820,017 A * 10/1998 Eliovson et al. ..... 229/217
5,826,752 A * 10/1998 Latimer ..... 222/105
5,890,629 A * 4/1999 Loew ..... 222/144.5
5,909,841 A * 6/1999 Andrews et al. ..... 229/125.15
6,053,401 A * 4/2000 Andrews, Sr. ..... 229/117.3
6,062,431 A * 5/2000 Geshay ..... 222/105
6,196,452 B1 * 3/2001 Andrews, Sr. et al. .. 229/125.15
6,290,124 B2 * 9/2001 Andrews et al. ..... 229/117.27
6,439,757 B2 * 8/2002 Lloyd ..... 366/130
6,652,134 B2 * 11/2003 Lloyd ..... 366/130
6,736,289 B2 * 5/2004 Cook et al. ..... 222/105
6,736,298 B2 * 5/2004 Busick et al. ..... 222/638
6,755,324 B2 * 6/2004 Geshay ..... 222/1
6,827,237 B2 * 12/2004 Yorn et al. ..... 222/105
6,910,798 B2 * 6/2005 Lloyd ..... 366/130
7,007,825 B2 * 3/2006 Crosland et al. ..... 222/105
7,389,909 B2 * 6/2008 Crosland et al. ..... 229/117.35
2003/0213813 A1 * 11/2003 Cook et al. ..... 222/105
2004/0089672 A1 5/2004 Crosland et al.
2005/0017011 A1 * 1/2005 Andrews, Sr. ..... 220/495.06
2005/0051573 A1 * 3/2005 Crosland et al. ..... 222/105
2007/0187435 A1 * 8/2007 Quirk ..... 222/481

FOREIGN PATENT DOCUMENTS

EP 273102 A1 7/1988
GB 1529062 10/1978
GB 2172663 A 9/1986
GB 2188305 A 9/1987
GB 2246764 A 2/1992

OTHER PUBLICATIONS

Pictures of disposable beverage dispensers as shown at http://www.bibpak.com, at least as early as November 13, 2001.
Pictures of "Camservers®" beverage dispensers as shown at http://us.cambro.com, at least as early as Nov. 13, 2002, mentioned in "Background" of application.
Picture of beverage dispenser as shown at http://us.cambro.com, at least as early as Nov. 13, 2002, mentioned in "Background" of application.

* cited by examiner

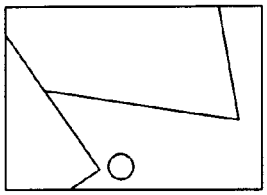

1) Lay out all pieces: Corrugated box, bag, cap, "no drip" faucet and angled platform.

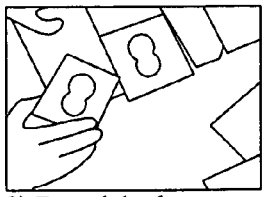

2) Detach both spout reinforcement collars from box.

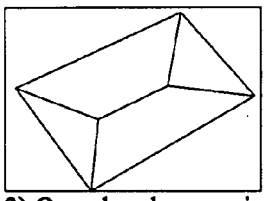

3) Open box by pressing on box sides. Perforated tabs located at box bottom should be positioned inward.

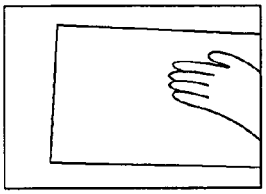

4) Using hands, press down on interior bottom tabs to secure and lock into place.

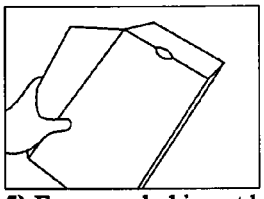

5) Form angled insert by folding all flaps down.

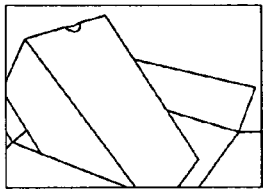

6) Slip insert into box, positioning the thumb-notch opposite the spout hole. Angled insert forms a false bottom to allow for enhanced dispensing.

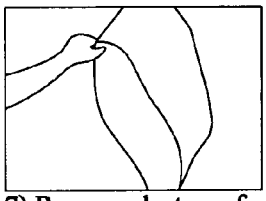

7) Remove dust cap from bag. "Fluff" bag by pulling apart at the middle of each side to assure free flow of liquid.

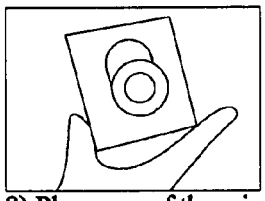

8) Place one of the reinforcement spout collars around inner-spout ring by snapping down to secure the collar around the ring.

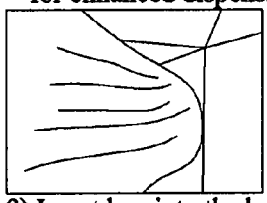

9) Insert bag into the box by aligning the spout with the spout hole. Push and pull spout through hole.

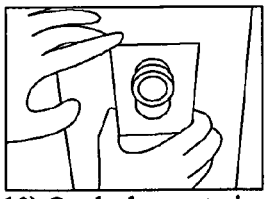

10) On the box exterior, place and secure second reinforcement collar.

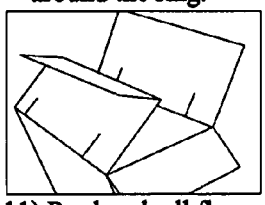

11) Pre-break all flap scorelines for easier folding and set-up.

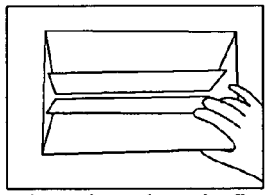

12) Push each main flap down, one at a time, into center of box.

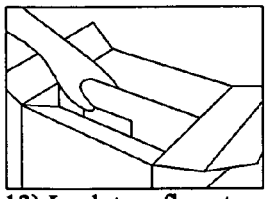

13) Lock two flaps together by securing handle tab around itself, bending the handle tab up.

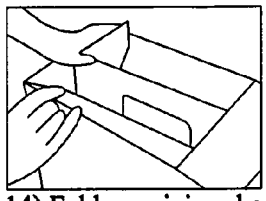

14) Fold remaining short flaps into slots to lock box top. *Handle is recessed.* Box assembly is complete.

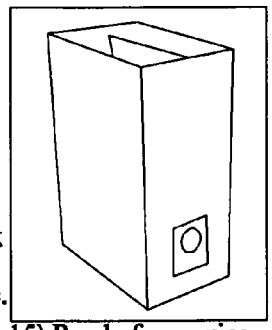

15) Ready for service.

FIG. 5

SUGGESTED FILLING STEPS:

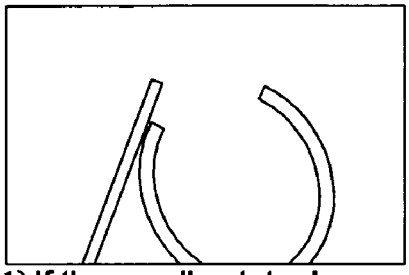

1) If three-gallon tote does not fit directly under tank faucet, fill by using a funnel or a faucet extension:

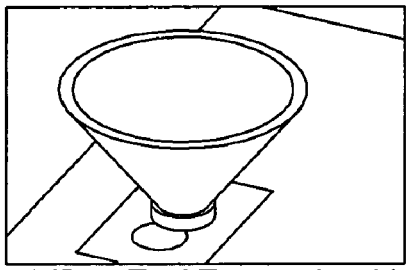

1a) Turn Tutti Tote on its side. Use a funnel to fill.

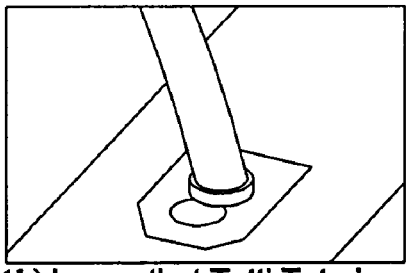

1b) Insure that Tutti Tote is on its side. Attach one end of hose onto faucet or faucet extension. Place other end inside of box. Fill.

NOTE: 3-gallon container holds up to 384 ounces. DO NOT OVERFILL.

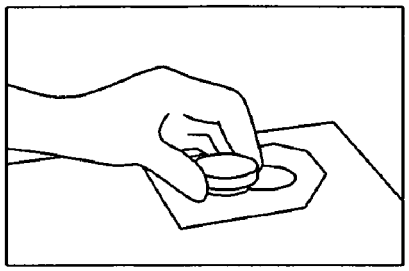

2) Screw dust cap on tightly while holding spout. Your Tutti Tote is ready for transport.

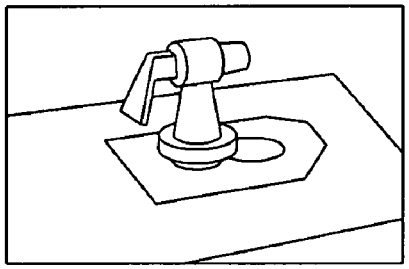

3) To dispense: while Tutti Tote is on its side, remove dust cap and screw on the faucet.

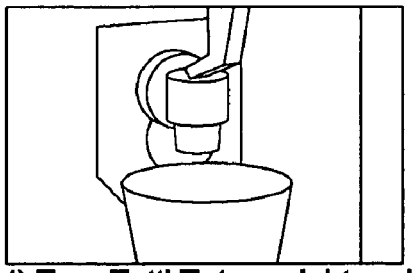

4) Turn Tutti Tote upright and it is ready for service. Place cup under faucet to fill. Enjoy!

FIG. 6

BAG-IN-BOX BEVERAGE CONTAINER

CROSS REFERENCE TO RELATED APPLICATIONS

This application is a continuation-in-part of U.S. patent application Ser. No. 10/293,878 filed Nov. 13, 2002 now U.S. Pat. No. 7,007,825 entitled "Bag-in-Box Beverage Container", which is also assigned to the assignee of the present application and which is also hereby incorporated by reference in its entirety.

BACKGROUND OF THE INVENTION

The present invention relates to bag-in-box style cartons and containers, of the type in which a non-self-supporting plastic bag or the like is positioned in a surrounding, supporting container structure, the entire package being disposable after a single use. The present invention also relates to a multiple bags-in-box style cartons and containers. The present invention also relates to large volume urn-style beverage containers.

Urn-style beverage containers, for the containment and controlled incremental dispensing of a relatively large volume (2+gallons) of liquid are known. Typically, such urn-style beverage containers are reusable devices of metal and plastic, which can be heavy, and which, of course, require cleaning after each use. Various versions of such devices are known as "pump pots"; "air pots"; various all-plastic urns (sold under the registered trademark "CamServers") and buckets with spigots, both manufactured by Cambro Manufacturing Company of Huntington Beach, Calif. There are also known in the art octagonal and rectangular cross-section bag-in corrugated paperboard box configurations, such as those sold by BIB Pak, Inc., of Racine, Wis. The rectangular bag-in-box construction is also shown in Geshay, U.S. Pat. No. 6,062,431, owned by BIB Pak, Inc., of Racine, Wis.

Retail and wholesale (catering) food service operators typically have need of such large volume beverage containers. However, permanent, reusable urns may be subject to various disadvantages and/or impose certain costs of operation, upon retail customers and/or retail and wholesale food service operators. For example, caterers must address the need to physically retrieve the urns, requiring expenditures of labor and fuel. The urns must be cleaned and stored, again requiring expenditures of labor, cleaning supplies, and storage space. Reusable urns are often the subject of theft or "mysterious" disappearance, imposing unscheduled replacement costs, as well as the replacement costs associated with the cycling out of units as a result of normal wear and tear. If units are lost/stolen or in disrepair, the business operator runs the risk of lost sales.

BRIEF DESCRIPTION OF THE INVENTION

In one aspect, a dispensing container for dispensing fluent material is provided. The dispensing container includes a generally tubular body having a front wall, a rear wall and two opposing sidewalls. The generally tubular body further includes an upper portion forming an upper opening and a closure structure disposed proximate the upper opening. The closure structure includes a handle in a recessed position within the upper opening. The generally tubular body further includes a plurality of spout apertures disposed in one of the sidewalls and at least one inner flow prompting ramp positioned within the generally tubular body. The at least one inner flow prompting ramp includes a lower end disposed adjacent the sidewall in which the plurality of spout apertures are disposed and a higher end disposed adjacent the opposite sidewall. The generally tubular body is formed from a first blank of at least one of the following materials: paper; paperboard; or corrugated paperboard.

In another aspect, a dispensing container for dispensing fluent material is provided. The dispensing container includes a body having a front wall, a back wall and two opposing sidewalls, and defining a vertical axis extending substantially parallel with the front wall, a depth axis extending substantially perpendicular to the front wall, and a transverse axis extending substantially parallel with the front wall and substantially perpendicular to the vertical axis. The body further includes an upper portion including an upper opening and an upper edge. The body further includes a closure structure disposed proximate the upper opening. The closure structure includes a handle structure positioned substantially parallel with the depth axis in a recessed position within the upper opening and extending substantially parallel with the vertical axis no higher than the upper edge. The body further includes a plurality of spout apertures operably disposed in one sidewall of the two opposing sidewalls.

In the description below, some embodiments describe a container having a single tubular body with one ramp and one nozzle such that the single tubular body can retain one beverage bag. In another embodiment, the container includes a single tubular body with more than one ramp, more than one beverage bag, and more than one nozzle such that the container may house a plurality of fluent products within the more than one bags. As such, at least some embodiments described below are configured to retain multiple beverage bags.

In one embodiment of the present invention, the present invention is directed to a dispensing container, operably configured to be positioned upon a substantially flat, horizontal surface, for the facilitated dispensing of at least one fluent material. The dispensing container comprises a generally tubular body, having a vertical axis, a depth axis and a transverse axis. A closure structure is disposed proximate an opening in an upper portion of the tubular body. The closure structure includes a handle structure, which is disposed in a recessed position within an upper opening of the generally tubular body and extending no higher than an upper edge region of the generally tubular body. The generally tubular body further has a plurality of sidewalls. At least one spout aperture is operably disposed in one of the plurality of sidewalls.

At least one inner flow prompting ramp is operably positioned within the generally tubular body. The inner flow prompting ramp has a lower end, disposed adjacent the sidewall of the generally tubular body in which the at least one spout aperture is disposed, and a higher end, disposed adjacent an opposite sidewall thereto, and an inclined surface extending between the lower end and the upper end. The lower end of the inner flow prompting ramp is disposed at a distance above the bottom of the generally tubular body approximately equal to the distance between the bottom of the generally tubular body and a bottom peripheral region of the spout aperture. The generally tubular body is preferably formed from a first blank of at least one of the following materials: paper; paperboard; corrugated paperboard.

In a preferred embodiment, the generally tubular body comprises a front wall, a rear wall disposed parallel to the front wall, and two sidewalls, disposed parallel to one another, perpendicular to the front and rear walls and extending therebetween.

The closure structure preferably comprises first and second foldable sidewall top flaps, emanating from top edge regions of the sidewalls. Each of the first and second foldable sidewall top flaps preferably includes a first panel, foldably connected to one of the sidewalls, and positioned at an acute included angle relative thereto. Each of the first and second foldable sidewall top flaps preferably includes a second panel, foldably connected to one of the first panels, each of the second panels being folded upwardly, parallel to the sidewalls and in juxtaposed overlying relation to one another, the second panels having top edges that are disposed no higher than the upper edge region of the generally tubular body. A foldable front wall top flap emanates from a top edge region of the front wall. A foldable rear wall top flap emanates from a top edge region of the rear wall. The foldable front and rear wall top flaps each includes first panels, foldably connected to the front and rear walls, respectively, and positioned substantially perpendicular thereto. The foldable front and rear wall top flaps each further include second panels, foldably connected to the respective first panels of the front and rear wall top flaps, and emanating downwardly therefrom, the second panels of the front and rear wall top flaps being disposed in positions interengaging with the second panels of the first and second sidewall top flaps, to preclude undesired dislodgement of the second panels of the first and second sidewall top flaps.

In another embodiment, the present invention includes an insulating panel to divide the tubular body into two separate compartments. The insulating panel allows a first compartment to house a bag having a first fluid at a first temperature while a second compartment houses a bag having a second fluid at a second temperature. The first and second temperatures may be different. The insulating panel is configured to facilitate maintaining the first and second temperatures such that heat loss between the two bags is reduced. In another embodiment, the tubular body is divided into a plurality of compartments each having a bag housed therein.

The closure structure preferably further comprises at least one slot in each of the first panels of the first and second sidewall top flaps. Preferably, at least one hooked tab emanates from each of the first panels of the front and rear wall top flaps. The hooked tabs are preferably configured to be engagingly received in the slots, when the second panels of the front and rear wall top flaps are folded over into interengagement with the second panels of the first and second sidewall top flaps.

Preferably, the closure structure further comprises at least one notch in each of the second panels of the first and second sidewall top flaps, the notches being aligned with one another when the second panels of the first and second sidewall top flaps are parallel to the sidewalls and in juxtaposed overlying relation to one another. A notch in at least one of the front and rear wall top flaps is operably configured to interengage with the aligned notches in the second panels of the first and second sidewall top flaps, when the second panels of the front and rear wall top flaps are folded over into interengagement with the second panels of the first and second sidewall top flaps.

Preferably, the handle structure comprises a hand opening aperture disposed in one of the second panels of the first and second sidewall top flaps. A hingedly connected push-out flap is preferably disposed in the other of the second panels of the first and second sidewall top flaps. The push-out flap preferably has a peripheral contour substantially conforming to the peripheral contour of the hand opening aperture. The push out flap is configured to be pushed through the hand opening aperture, and upwardly relative thereto, to provide a grasping opening. The inner flow prompting ramp preferably is formed from a second blank fabricated from at least one of the following materials: paper; paperboard; corrugated paperboard.

In a preferred embodiment of the invention, the at least one inner flow prompting ramp is formed from a separate second blank of foldable material, which is insertably received into the generally tubular body. In one embodiment of the invention, the inner flow prompting ramp is formed from a substantially cruciform blank having a central rectangular panel, rectangular panels emanating from front and rear edge regions of the central panel, and trapezoidal panels emanating from side edges of the central panel. In one embodiment of the invention, the substantially cruciform blank further includes foldable support panels emanating from side edges of the panels emanating from the front and rear edge regions of the central panel. In another embodiment of the invention, the substantially cruciform blank further includes interlocking bottom panels emanating from side edge regions of the trapezoidal panels.

In another embodiment of the invention, the substantially cruciform blank further includes inwardly folding triangular gusset panel pairs foldably connecting side edge regions of the rectangular panels emanating from the front and rear edge regions of the central panel to end edge regions of the trapezoidal panels emanating from the side edge regions of the central panel.

In an embodiment of the invention, the at least one inner flow prompting ramp is formed from a blank comprising a central rectangular panel; trapezoidal side panels emanating from outside edges of the central panel; rectangular bottom panels, emanating from outside edges of the trapezoidal side panels; center support panels emanating from outside edges of the rectangular bottom panels; and inside inclined panels emanating from outside edges of the rectangular bottom panels. The ramp is formed upon successive inward folding of outermost ones of the panels, so that the trapezoidal side panels are folded perpendicular to the central rectangular panel, the rectangular bottom panels are folded perpendicular to the trapezoidal side panels, the center support panels are folded perpendicular to the rectangular bottom panels, and the inside inclined panels are folded perpendicular to the center support panels, and in underlying parallel juxtaposed relation to the central rectangular panel. A pivotable interlocking tab is disposed in one of the rectangular bottom panels and an aperture disposed in the other of the rectangular bottom panels for receiving the pivotable interlocking tab, for maintaining the blank in its articulated configuration.

In an embodiment of the invention, the at least one inner flow prompting ramp comprises a member foldably formed from at least one extension of, and connected to, the first blank.

The dispensing container preferably further comprises front and rear wall bottom flaps, connected to bottom edge regions of the front and rear walls, respectively. First and second sidewall bottom flaps are connected to bottom edge regions of the first and second sidewalls, respectively. Each of the first and second sidewall bottom flaps preferably includes a pivotable engagement flap, which is affixed to an outside surface of one of the front and rear bottom wall flaps. The generally tubular body in a preferred embodiment is operably configured such that when the closure structure is open, the generally tubular body may be articulated between a collapsed configuration, in which the front wall and one sidewall are disposed in juxtaposed overlying adjacent orientation to the other sidewall and the rear wall, with the front and rear wall bottom flaps being folded up inside a bottom opening region of the generally tubular body, in juxtaposed relation to inside bottom surfaces of the front and rear walls, respectively, and the respective pivotable engagement flaps are folded back upon their respective first and second sidewall bottom flaps; and an articulated position, wherein the front and rear walls are parallel to each other and perpendicular to the sidewalls, whereupon articulation from the collapsed configuration, the first and second sidewall bottom flaps and their respective attached front and rear wall bottom panels are automatically prompted to move into partial overlapping relation to the front and rear wall bottom flaps to define a bottom for the articulated dispensing container.

Preferably, the first and second sidewall bottom flaps further each include engagement tabs which interlock, upon articulation, to maintain the first and second sidewall bottom flaps and the front and rear bottom flaps in their partially overlapping, bottom defining orientation.

The dispensing container preferably further comprises at least one inner bag, operably configured for containing a liquid, and at least one spout structure, operably associated with the bag, configured to be passed through at least one spout aperture, upon placement of the inner bag within the generally tubular body. A dispensing spigot preferably is operably configured to be positioned on the at least one spout structure, after passage of the at least one spout structure through the at least one spout aperture of the generally tubular body.

In a preferred embodiment, at least one locking member is operably configured for engaging the spout structure, after placement of the spout structure through the spout aperture of the generally tubular body, for precluding removal of the spout structure from the spout aperture.

In an alternative preferred embodiment of the invention, at least one further spout aperture is operably disposed in one of the plurality of sidewalls.

In another alternative embodiment, the tubular body is divided into multiple sections by insulating panels. The multiple sections each include a ramp directed towards a spout aperture in the tubular body. Each multiple section is configured to receive a beverage bag containing a spout structure such that the spout structure is received through the aperture of the tubular body. The insulating panel is configured to enable a first compartment to house a bag having a first fluid at a first temperature while a second compartment houses a bag having a second fluid at a second temperature. Furthermore, the multiple ramps may be ramped at different directions such that the multiple spout structures are received through different sides of the tubular body. In another embodiment, the tubular body is divided into a plurality of compartments by a plurality of insulating panels wherein each compartment includes a ramp, a beverage bag and a spout structure for dispensing the beverage.

BRIEF DESCRIPTION OF THE DRAWINGS

FIG. 5 is a photographic step-by-step illustration of the assembly of a bag-in-box beverage container of the present invention.

FIG. 6 is a photographic step-by-step illustration of the filling of a bag-inbox beverage container of the present invention.

DETAILED DESCRIPTION OF THE INVENTION

Figure 1:
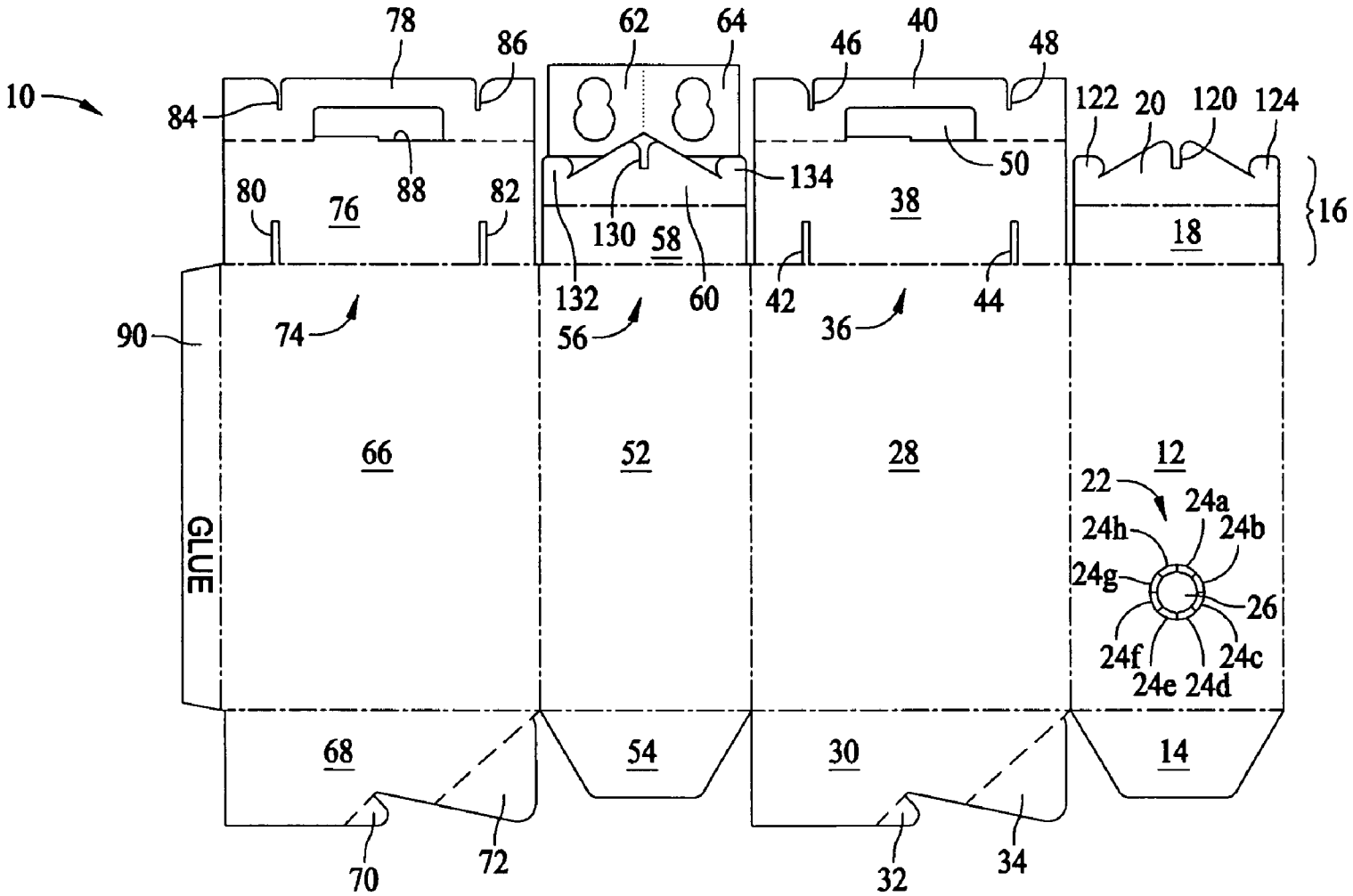
FIG. 1 is a plan view for the blank for the outer shell for the bag-in-box beverage container of the present invention.
Figure 2:
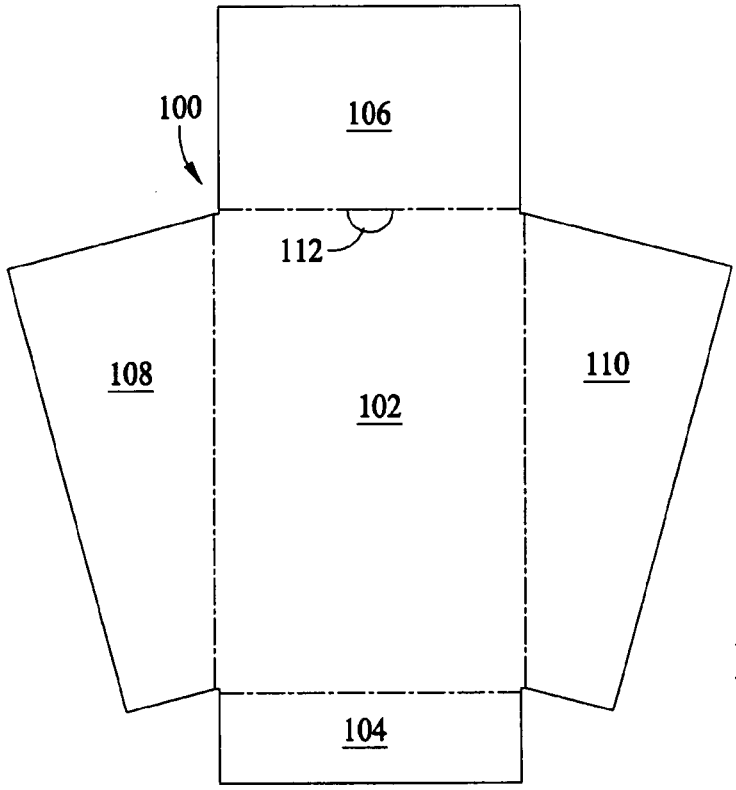
FIG. 2 is a plan view for the blank of an inner flow prompting ramp, for insertion into the outer shell for the bag-in-box beverage container of the present invention.

While this invention is susceptible of embodiments in many different forms, there are shown in the drawings and will be described in detail, several specific embodiments, with the understanding that the present disclosure is to be considered as an exemplification of the principles of the invention and is not intended to limit the invention to the embodiments illustrated.

As explained below, FIGS. 1-14 show an example embodiment of the present invention having a single bag-in-box. In another embodiment of the present invention, FIGS. 15-21 show a container having more than one bags-in-box. More specifically, FIGS. 15-21 show a bag-in-box container having two separate bags housed inside a single box, wherein the box has two spout apertures: one for each bag.

In preferred embodiments of the invention, each of the blanks illustrated herein, in FIGS. 1-4, 15 and 17, are fabricated from corrugated paperboard material, although similar paper-based materials, having similar performance characteristics, may be employed if desired.

In accordance with the usual conventions regarding the illustration of blanks of foldable material, unless otherwise expressly indicated, solid lines within the interior of a blank represent through-cuts or apertures, and broken or dotted lines represent lines of weakness, such as score lines, perforations, or the like.

A blank 10 for the outer shell for the bag-in-box of the present invention is illustrated in FIG. 1. Blank 10 includes front wall 12; front bottom flap 14; and top handle flap 16, which in turn includes panels 18 and 20. Spout aperture 22 is defined by cut flaps 24*a*-24*h* and central aperture 26. Blank 10 also includes first sidewall 28 (foldably connected to front wall 12); sidewall bottom flap 30 with scored tabs 32, 34; and first sidewall handle flap 36, including panels 38, 40, with slots 42, 44, and notches 46, 48, and die cut push out flap 50. Rear panel 52 is foldably connected to first sidewall 28. Rear bottom flap 54 emanates from rear panel 52, as does rear handle flap 56, which includes, in turn, panels 58 and 60. Frangibly attached to panel 60 are foldably connected spout locking tabs 62, 64, each having keyhole shaped apertures therein. Second sidewall 66 is foldably connected to rear panel 52. Second sidewall bottom flap 68 emanates from second sidewall 66, and includes foldably connected tabs 70, 72. Second sidewall handle flap 74 includes panels 76, 78, slots 80, 82, notches 84, 86 and opening 88. Glue flap 90 is provided, which is affixed to an outside or inside surface of front panel 12.

To form the outer shell of the bag-in-box beverage container of the present invention, when blank 10 is formed into a tube by gluing flap 90 to front panel 12, front bottom flap 14, first sidewall bottom flap 30, rear bottom flap 54 and second sidewall bottom flap 68 are folded inwardly, and upwardly of the bottom edges of front wall 12, first sidewall 28, rear wall 52 and second sidewall 66. Tabs 72 and 34 are glued to adjacent panels 54 and 14, respectively. When set up, opposing flaps 68 and 30 are interlocked at the notches formed between tabs 32, 34 and 20, 72, respectively. Tabs 32, 70 are on the "inside" facing the interior of the resulting shell structure. See also sub*figs*. 3 and 4 of FIG. 5.

Because the interior liquid holding structure is a non-self-supporting flexible bag, a structure is required to prompt the liquid to flow toward the spout (see FIGS. 5-15 and 6-1 through 6-4). To form the flow prompting structure, an inner flow prompting ramp is formed from blank 100 (see FIG. 2). Blank 100 includes inclined panel 102, short front panel 104 (which has a height approximately equal to the distance between the bottom edge of front panel 12 and the lower periphery of spout aperture 22, tall rear panel 106, and trapezoidal side panels 108, 110, all of which will be folded to be parallel to respective front wall 12, rear wall 52, and first and second sidewalls 28 and 66, respectively, upon insertion of the inner flow prompting ramp into the top opening of the shell (see FIGS. 5-5 and 5-6). Finger notch 112 is provided, to facilitate removal and/or replacement of the inner flow prompting ramp formed from blank 100, during assembly and knockdown of the beverage container.

Once the inner flow promoting ramp has been inserted into the outer shell, the inner containment bag/closure assembly, which may be of any suitable design, is prepared for insertion into the outer shell. In one embodiment of the invention, the bag/closure assembly will be formed as a polyethylene (or other suitable food-grade plastic material) bag, at one end of which is attached an outwardly threaded male spout member, which will typically have two axially spaced apart radially extending collars or rings, each of which is smaller in diameter than the large diameter portion of the keyhole openings of spout locking tabs 62, 64, but which is greater in diameter to the smaller diameter portion of the keyhole openings. Typically, a dust cap is threaded onto the spout member to prevent contamination of the interior of the bag during shipping and storage. Referring to FIGS. 5-7-5-10, the bag/closure assembly is prepared by removing the dust cap, expanding or "fluffing" the bag by pulling apart the (typically) folded over bag portion. FIG. 5-7. The spout locking tabs 62, 64 are pulled from panel 60, and separated from each other. One of tabs 62, 64 is then placed over the male spout member to a position between the bag and the collar closest to the bag, and slid to one side, so that the smaller diameter portion of the keyhole aperture surrounds the spout, and the collar prevents removal of the spout from the collar. FIG. 5-8. The bag/spout assembly is then placed inside the outer shell, and the spout is pushed through the aperture 22. FIG. 5-9. The collar farthest from the bag will momentarily displace tabs 24*a*-24*h*, as the spout member passes through aperture 22, with tabs 24*a*-24*h* then flipping back down to approximately their original positions, behind the outer collar. To fix the collar in place the second of spout locking tabs 62, 64, is slid onto the spout member, and similarly positioned between the outer collar and the front wall, and then slid to one side so that the narrow diameter portion of the keyhole opening surrounds the spout member, preventing displacement of the spout relative to the front wall. FIG. 5-10.

The outer shell is then closed by folding panels 38, 76 inwardly and down into the top opening of the outer shell, while folding panels 40 and 78 upwardly. Panels 40 and 78 will be juxtaposed parallel to and against one another, in a vertical orientation. FIGS. 5-11 through 5-13. Then, panels 18 and 58 are folded inwardly over the top of the outer shell, to positions coplanar to each other and parallel to the bottom of the outer shell. Panels 20 and 60 are then folded down to positions parallel to each other and to front wall 12. Notch 120 will interdigitate with notches 48 and 84 which will be aligned with one another, while hooked tabs 122 and 124 will be inserted into and engage slots 44 and 80, respectively. Notch 130 will interdigitate with notches 46 and 86, while hooked tabs 132, 134 will be inserted into and engage slots 82, 42, respectively. Panel 50 is then pushed through the opening 88 of adjacent panel 78, and folded upward, during carrying, to help hold panels 40, 78 together. Through the use of the hooked tabs, the handle is firmly locked into place, and will be unlikely to spontaneously dislodge or disassemble, during normal use and loading conditions, in the absence of affirmative, intentional dismantling of the container.

If the bag-in-box beverage container is not to be immediately used, it may be stored, upon returning the dust cap to its position screwed onto the male spout member. Filling of the container is demonstrated in FIGS. 6-1 through 6-4. Once filling has been accomplished, then a female cap, provided with a positive closing tap (which may be of any suitable configuration) is screwed onto the male spout member, the container is uprighted, and rendered ready for dispensing.

Once the contents have been consumed, the bag-in-box beverage container is broken down for disposal and recycling essentially by reversing the foregoing procedure.

Figure 3:
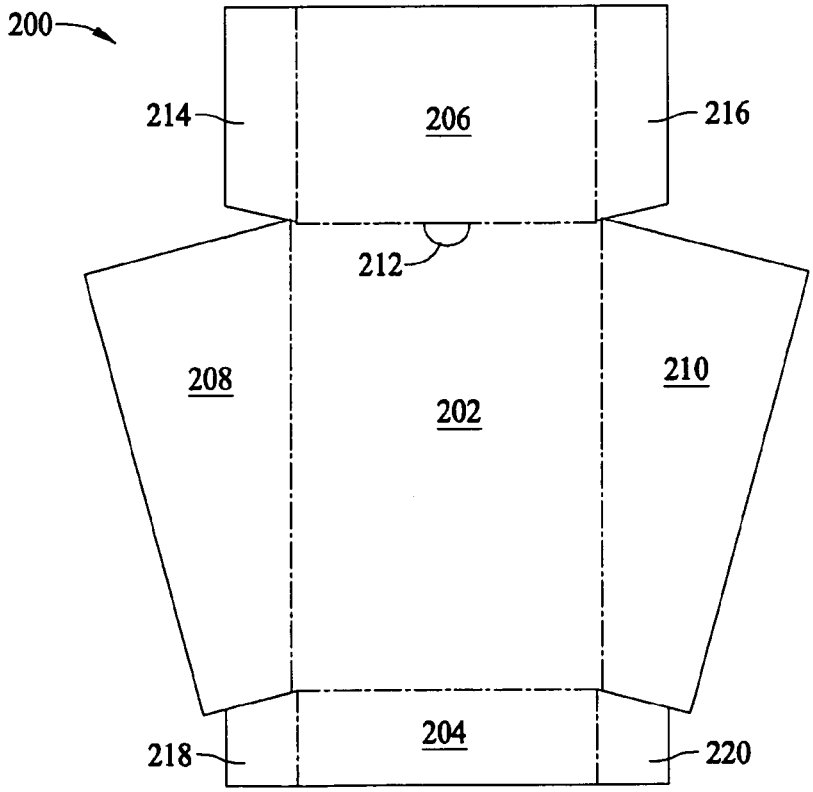
FIG. 3 is a plan view for the blank of an alternative embodiment of an inner flow prompting ramp, for insertion into the outer shell for the bag-in-box beverage container of the present invention.

FIG. 3 illustrates a blank for an alternative embodiment of the flow prompting structure. An inner flow prompting ramp is formed from blank 200. Blank 200 includes inclined panel 202, short front panel 204 (which has a height approximately equal to the distance between the bottom edge of front panel 12 and the lower periphery of spout aperture 22; tall rear panel 206; and trapezoidal side panels 208, 210, all of which will be folded to be parallel to respective front wall 12, rear wall 52, and first and second sidewalls 28 and 66, respectively, upon insertion of the inner flow prompting ramp into the top opening of the shell. Finger notch 212 is provided, to facilitate removal and/or replacement of the inner flow prompting ramp formed from blank 200, during assembly and knockdown of the beverage container. Blank 200 also includes reinforcing corner panels 214, 216, 218 and 220.

Figure 4:
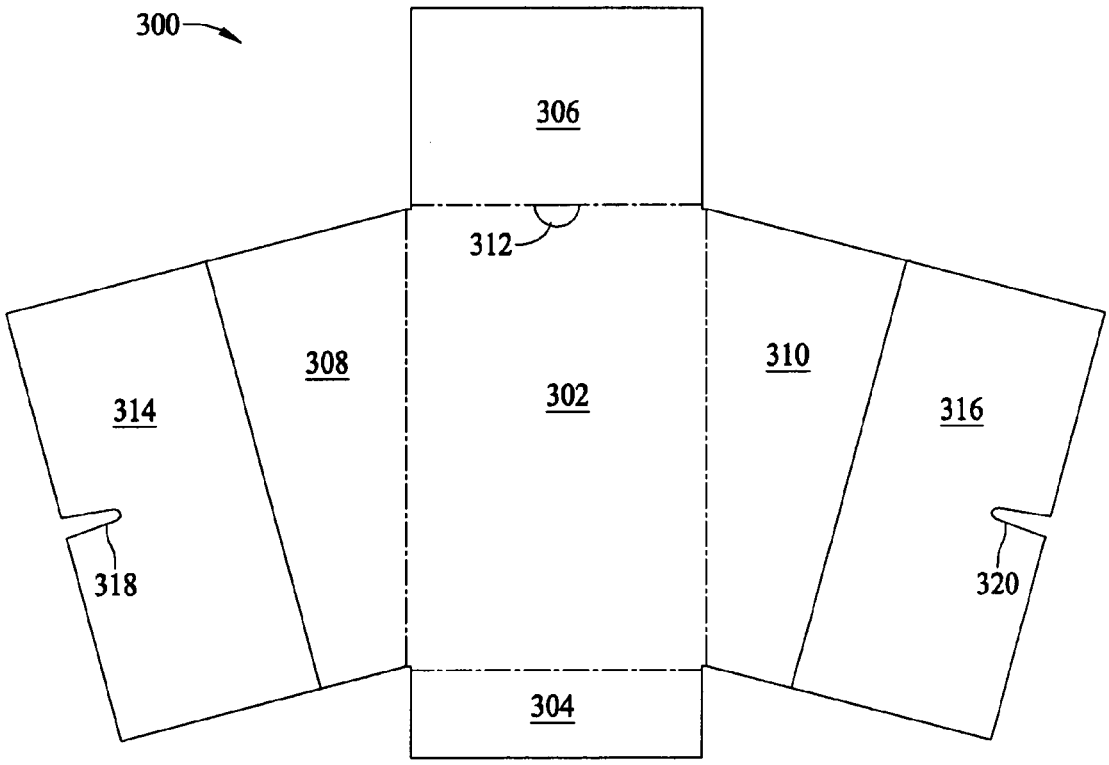
FIG. 4 is a plan view for the blank of an alternative embodiment of an inner flow prompting ramp, for insertion into the outer shell for the bag-in-box beverage container of the present invention.

FIG. 4 illustrates a blank for an alternative embodiment of the flow prompting structure. An inner flow prompting ramp is formed from blank 300. Blank 300 includes inclined panel 302, short front panel 304 (which has a height approximately equal to the distance between the bottom edge of front panel 12 and the lower periphery of spout aperture 22; tall rear panel 306; and trapezoidal side panels 308, 310, all of which will be folded to be parallel to respective front wall 12, rear wall 52, and first and second sidewalls 28 and 66, respectively, upon insertion of the inner flow prompting ramp into the top opening of the shell. Finger notch 312 is provided, to facilitate removal and/or replacement of the inner flow prompting ramp formed from blank 300, during assembly and knockdown of the beverage container. Blank 300 also includes bottom panels 314, 316, which will be folded into interlocking relation to one another underneath inclined panel 302, via notches 318, 320.

The bag-in-box beverage container of the present invention is believed to embody a number of advantages over prior art containers, even including prior art corrugated containers, such as facilitated assembly and readiness; facilitated filling of the internal bag; facilitated handling and delivery, via the recessed and locked-in-place handle; easy knock-down for recycling; the ability to employ a wide variety of existing taps and spigots; the provision of a level, flat top profile to permit stacking of stored containers, and even limited stacking of filled containers.

Figure 7A:
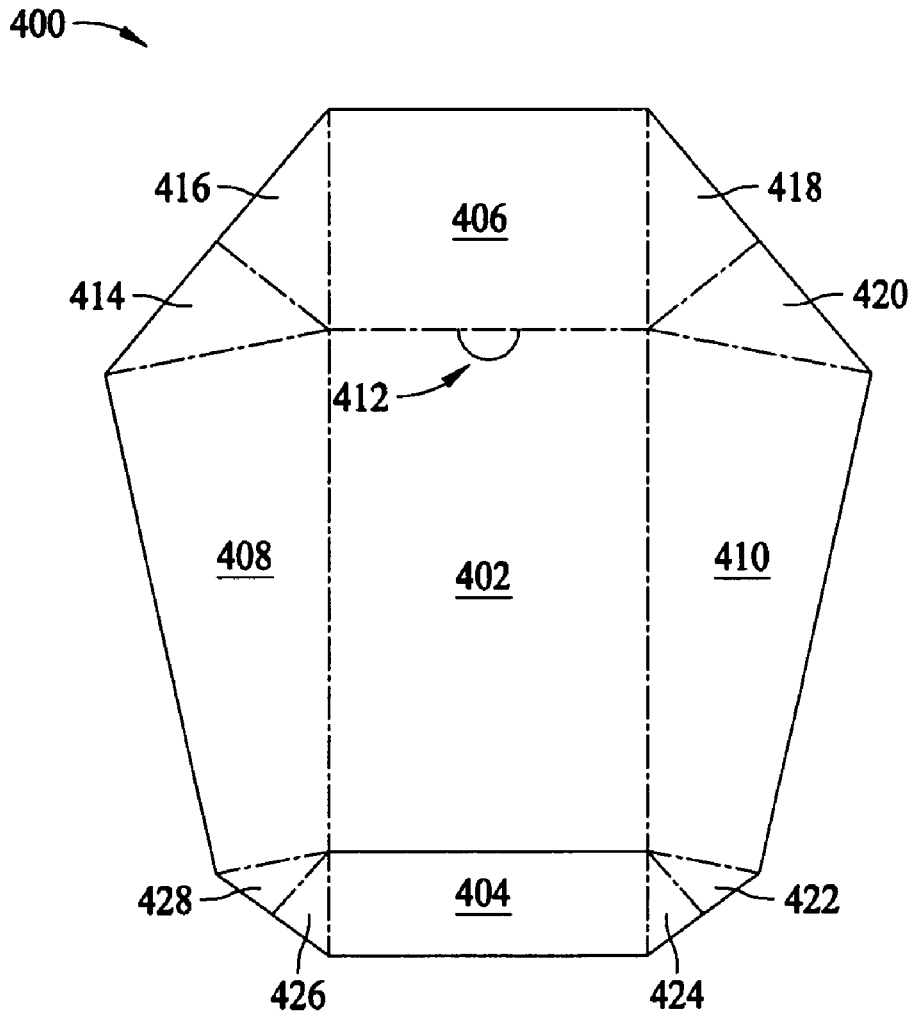
FIG. 7A is a plan view for the blank of an alternative embodiment of an inner flow prompting ramp, for insertion into the outer shell for the bag-in-box beverage container of the present invention.
Figure 7B:
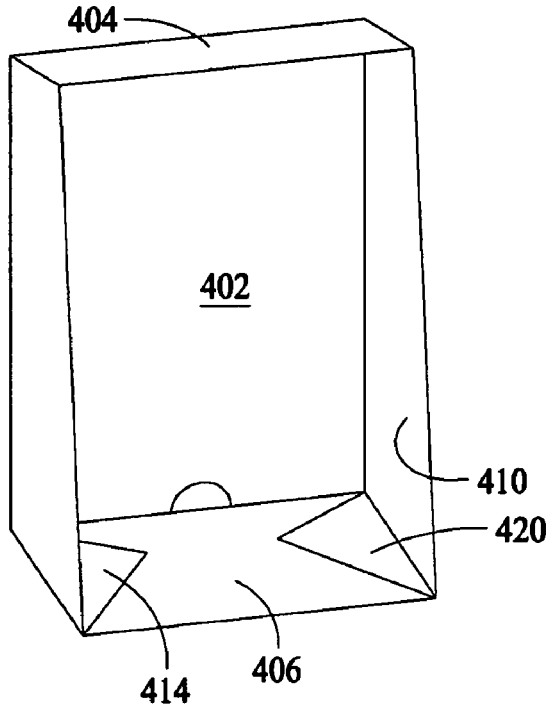
FIG. 7B is a view of the inner flow prompting ramp erected from the blank of FIG. 7A, as seen from underneath.
Figure 7C:
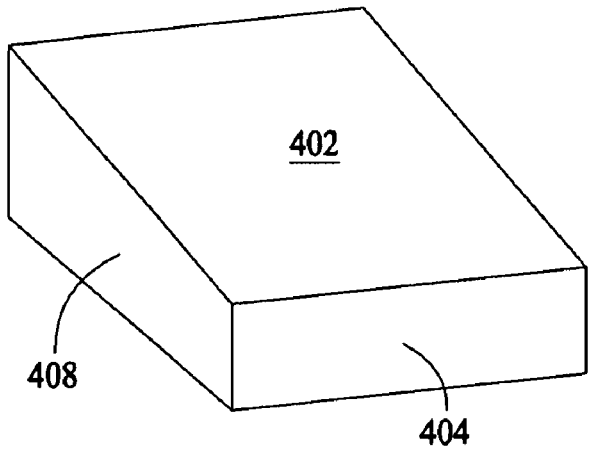
FIG. 7C is a view of the inner flow prompting ramp erected from the blank of FIG. 7A, as seen from above.

FIG. 7A is a plan view for the blank of an alternative embodiment of an inner flow prompting ramp, for insertion into the outer shell for the bag-in-box beverage container of the present invention, seen from above in FIG. 7C. Blank 400 includes inclined panel 402; front panel 404; rear panel 406; side panels 408, 410; die cut grasping aperture 412; and gusset panel pairs 414, 416; 418, 420; 422, 424; 426, 428. When panels 404, 406, 408, 410 are folded down, in a manner similar to the other embodiments described hereinabove, the gusset panel pairs are folded inwardly, underneath inclined panel 402, as seen in FIG. 7B.

Figure 8:
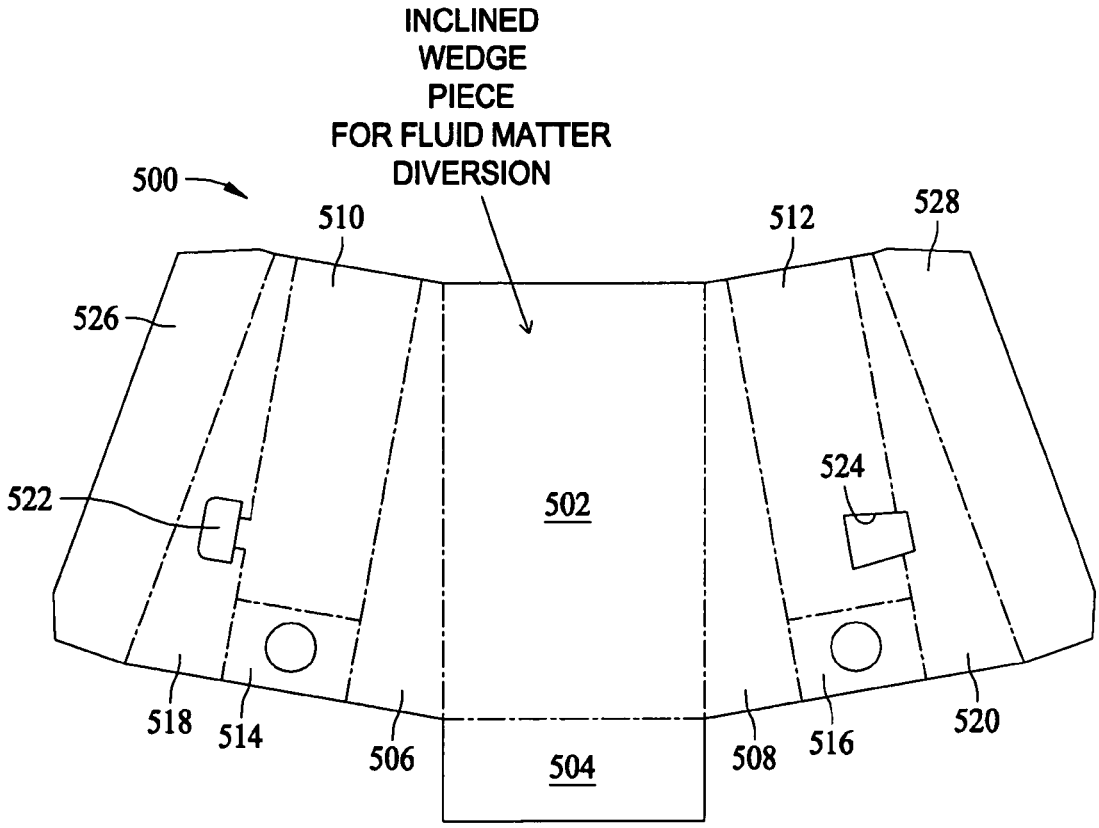
FIG. 8 is a plan view for the blank of an alternative embodiment of an inner flow prompting ramp, for insertion into the outer shell for the bag-in-box beverage container of the present invention.
Figure 9:
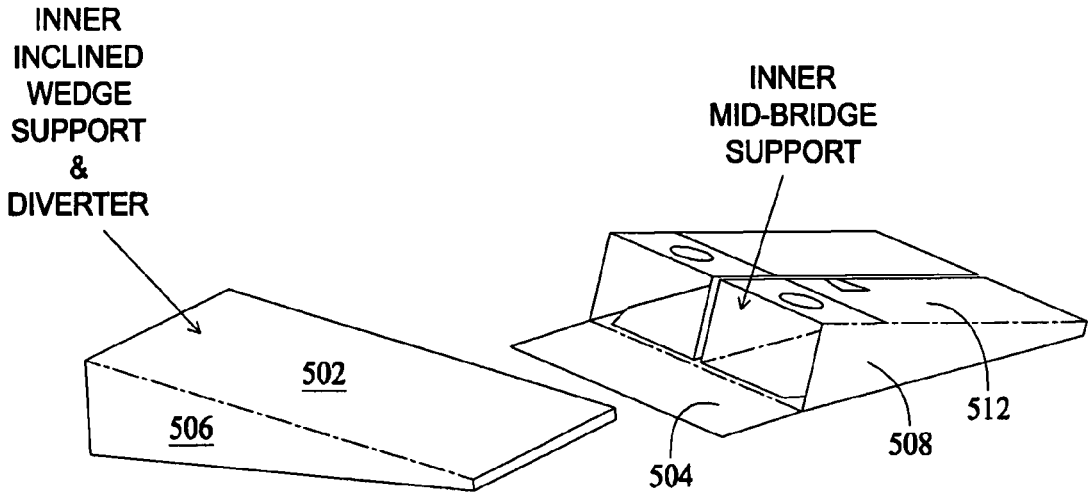
FIG. 9 is a composite illustration of two perspective views of the ramp structure that is formed from the blank of FIG. 8.

FIG. 8 is a plan view for the blank of an alternative embodiment of an inner flow prompting ramp, for insertion into the outer shell for the bag-in-box beverage container of the present invention. Blank 500 comprises inclined panel 502; rear panel 504; side panels 506, 508; bottom panels 510, 512 with cell flaps 514, 516; center support panels 518, 520; and inside inclined panels 526, 528. To form the ramp, the panels at the ends of blank 500 are successively folded inwardly (panels 528, 526 folded perpendicular to panels 518, 520; panels 518, 520 are folded perpendicular to panels 510, 512; panels 510, 512 are folded perpendicular to panels 506, 508; and finally panels 506, 508 are folded perpendicular to panel 502), so that panels 526, 528 eventually are positioned underneath panel 502, in juxtaposed underlying parallel relationship thereto. T-shaped tab 522 is pushed out and folded over and pushed into aperture 524, to lock the ramp into its articulated configuration, as shown in FIG. 9, which is a composite illustration of two perspective views of the ramp structure that is formed from the blank 500 of FIG. 8. Cell flaps 514, 516 are pivotable to enable the storage within the ramp of articles, such as measuring cups or the like rear panel 504 may be folded downwardly to cover the ends of the wedgeshaped enclosed areas at the end of the ramp, or folded upwardly (both as shown in FIG. 9).

Figure 10:
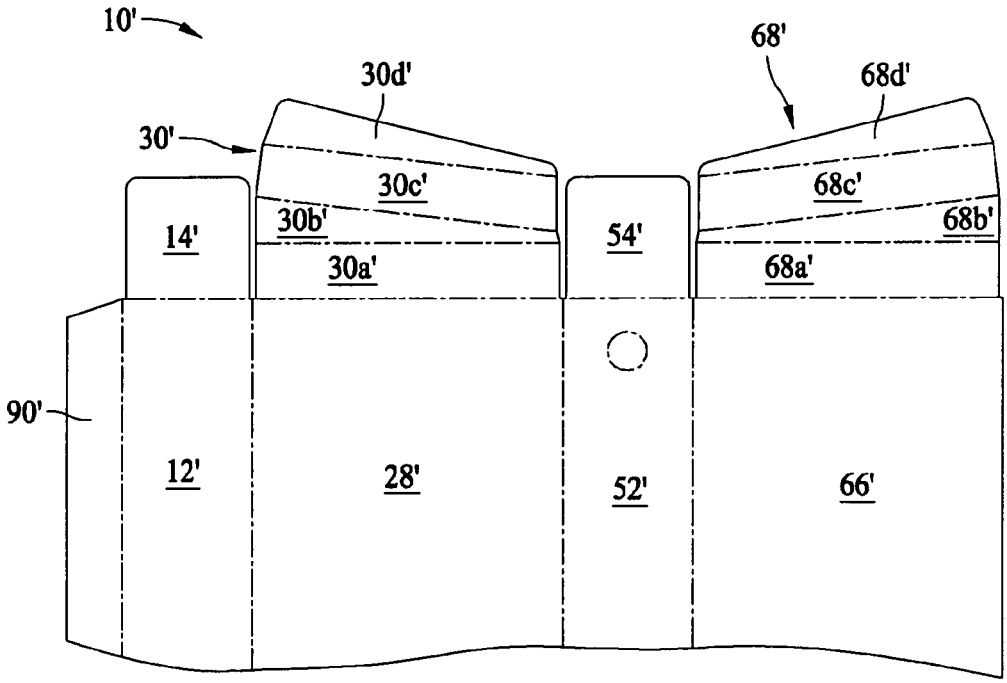
FIG. 10 is a plan view for the blank of an alternative embodiment of the invention, wherein the inner flow prompting ramp is integrally formed into the blank for the outer shell.
Figure 11:
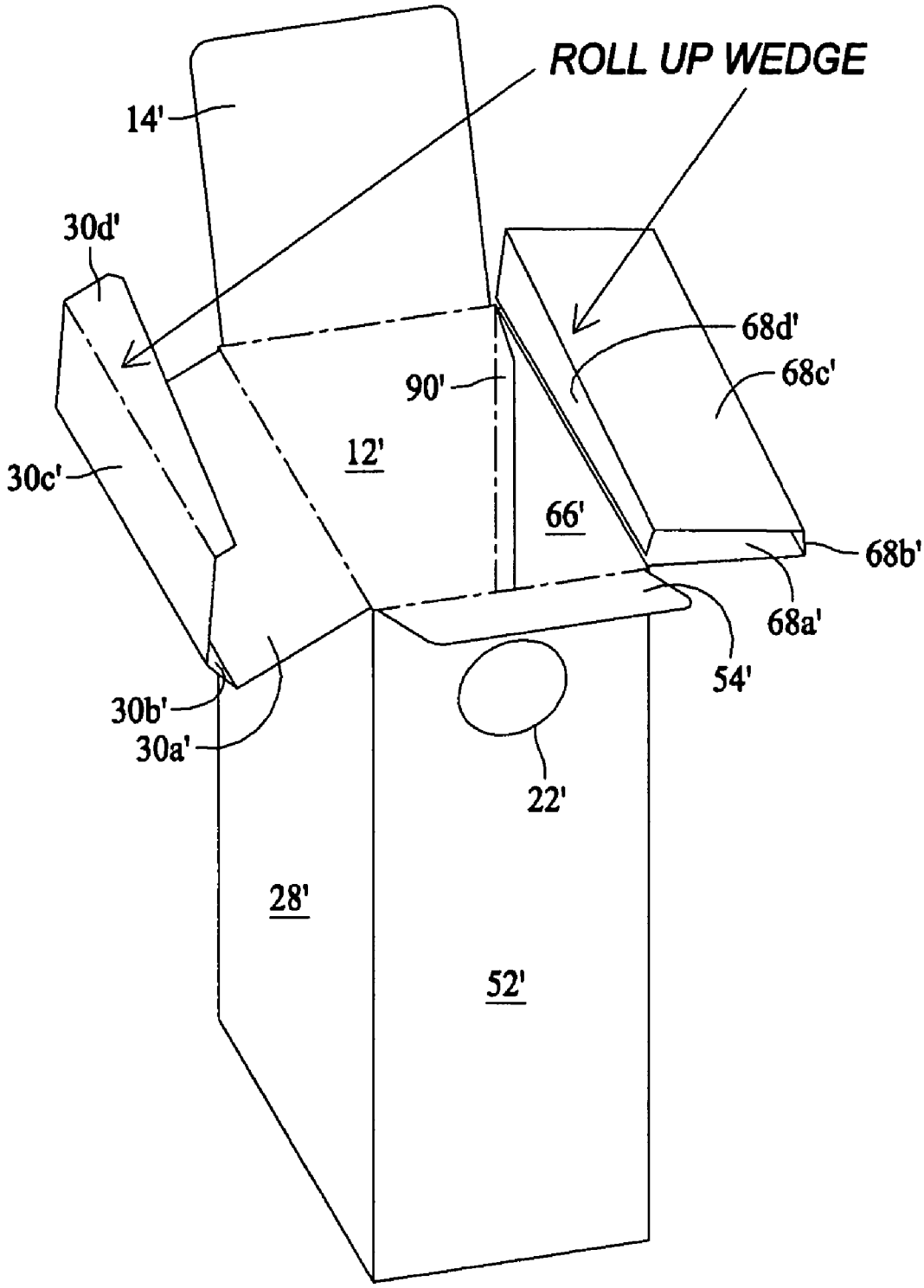
FIG. 11 is a perspective view of an outer shell according to the blank of FIG. 10, wherein the inner flow prompting ramp is integrally formed into the blank for the outer shell.

FIG. 10 is an outside plan view of a portion of the blank 10' of an alternative embodiment of the invention, wherein the inner flow prompting ramp is integrally formed into the blank for the outer shell. Instead of having an automatically deploying bottom, for the outer shell, as shown in FIG. 1 and FIG. 5, panels 14, 30, 54 and 68 may be replaced, respectively, by panels 14', 30' 54' and 68'. Panels 30' and 68' are, in turn, formed by bottom panels 30*a*', 68*a*'; inside support panels 30*b*', 68*b*'; inclined panels 30*c*', 68*c*'; and outside support panels 30*d*', 68*d*'. These panels are rolled up, in a manner similar to the separate wedge-shaped ramp of FIGS. 8 and 9, as shown in FIG. 11. Thereafter, panels 14' and 54' are folded to the outside of panels 30*a*' and 68*a*' and glued thereto. Aside from the foregoing differences, blank 10' preferably may be substantially the same as blank 10 in configuration, with respect to the top end closing and handle structures, and with respect to the spout aperture.

Figure 12:
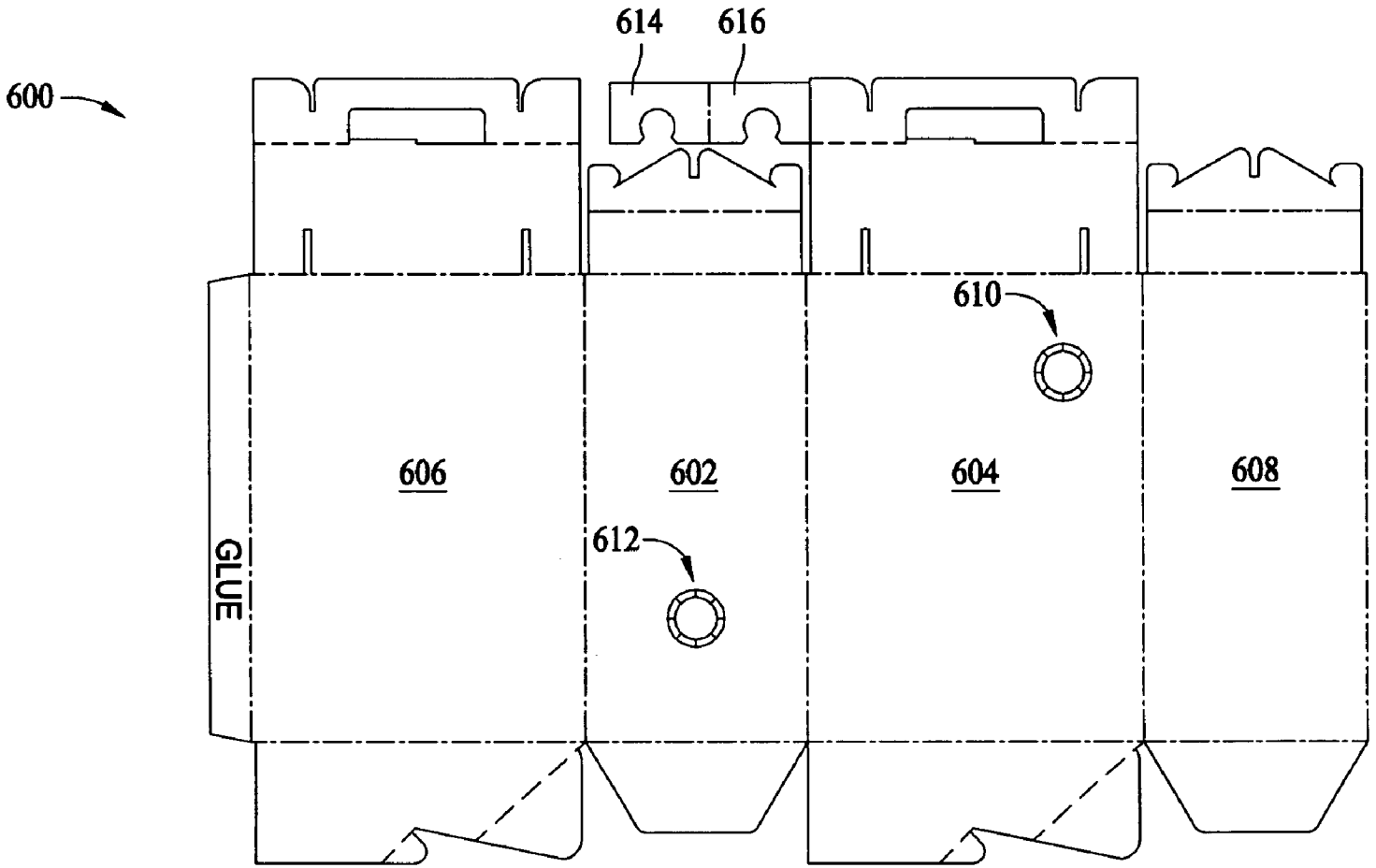
FIG. 12 is a plan view of a blank for an outer shell according to an alternative embodiment of the invention, wherein spout apertures are provided on both front and sidewalls.

FIG. 12 illustrates a blank 600 for an outer shell according to an alternative embodiment, wherein the front wall 602 is now located between the sidewalls 604, 606, instead of at the end of the blank, as in the embodiment of FIG. 1, and rear wall 608 is now at the end of the blank, instead of being between the sidewalls as in the embodiment of FIG. 1. In addition, a spout aperture 610 is located on sidewall 604, as well as spout aperture 612 on front wall 602, so that a choice is given as to the location of the spout, and indeed the orientation of the outer shell. The remaining panels and flaps at the top and bottom of the blank, are, as can be seen in a comparison of FIGS. 1 and 12, essentially identical in structure and operation. Accordingly, the same method of formation of the top and bottom closures, as described with respect to the embodiment of FIG. 1, applies to the embodiment of FIG. 12. Slightly different spout locking pieces 614, 616 are provided, which emanate from one of the sidewall top flap panels. Locking pieces 614, 616 are not slipped over the spout, but instead are simply slipped in place from the side, relying upon orientation and friction to be maintained in place during use. Aperture 610 permits the container formed from blank 600 to be inverted or laid on its side (depending upon the size, shape and orientation of the inner flow prompting ramp within the outer shell). For example, if the ramp has a "footprint" that is approximately the same as the top/bottom area (with appropriate inclination), then the outer shell will be inverted, to enable use of aperture 610. Alternatively, if a ramp is provided that has a footprint that is approximately the same as front wall 602 or rear wall 608, then the outer shell will be laid on its side (i.e., on rear wall 608), to permit dispensing from aperture 610.

Figure 13:
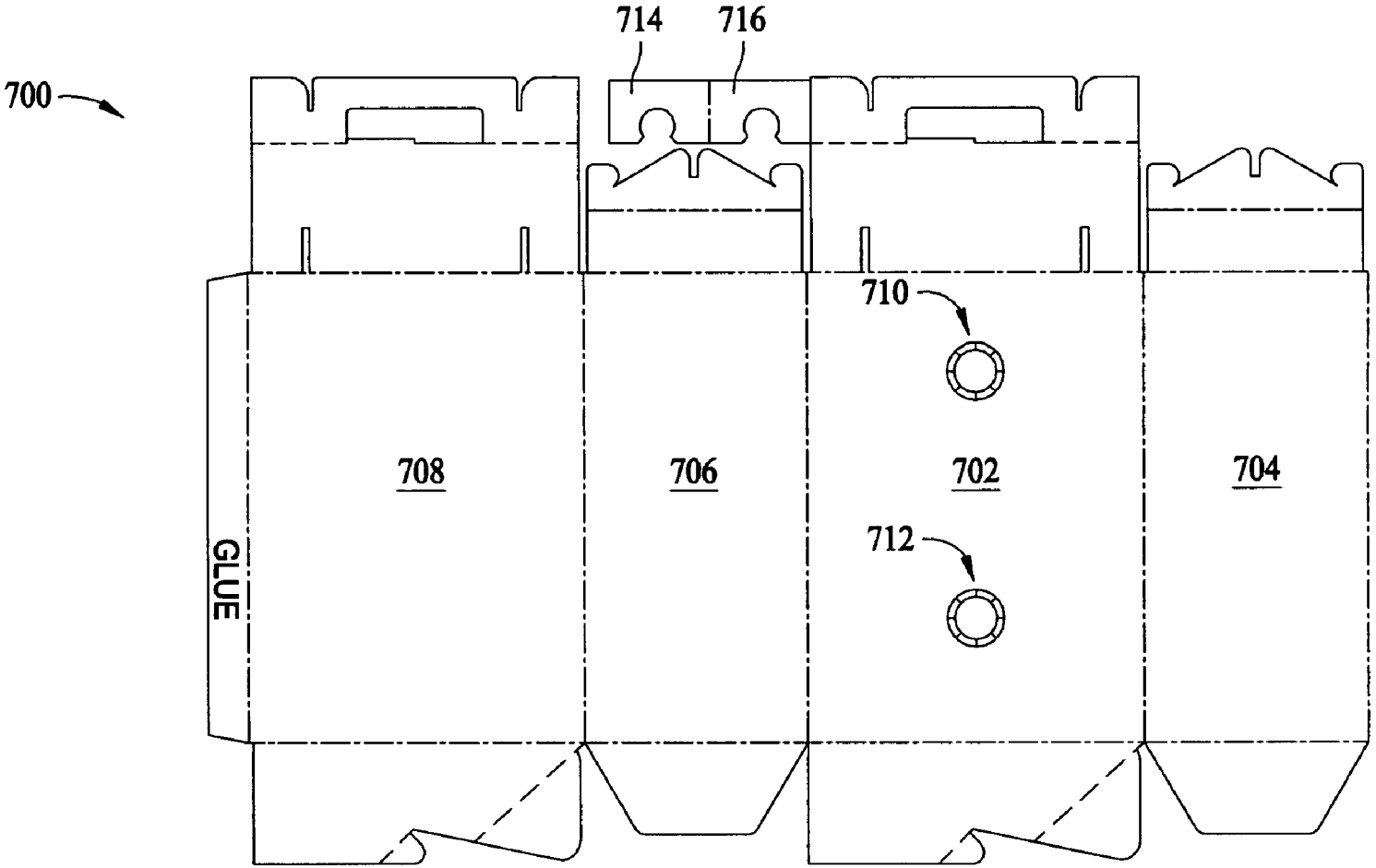
FIG. 13 is a plan view of a blank for an outer shell according to another alternative embodiment of the invention, wherein two spout apertures are provided on the front wall, so that, if desired, the outer shell may be inverted when in use.

FIG. 13 illustrates a blank 700 for an outer shell according to another alternative embodiment of the invention, having sidewall 702, front wall 706, rear wall 704, and other sidewall 708. Two apertures 710 and 712 are provided at the top center and bottom center of sidewall 702. Slightly different spout locking pieces 714, 716 are provided, which emanate from one of the sidewall top flap panels. Locking pieces 714, 716 are not slipped over the spout, but instead are simply slipped in place from the side, relying upon orientation and friction to be maintained in place during use. The remaining panels and flaps at the top and bottom of the blank, are, as can be seen in a comparison of FIGS. 1 and 13, essentially identical in structure and operation. Accordingly, the same method of formation of the top and bottom closures, as described with respect to the embodiment of FIG. 1, applies to the embodiment of FIG. 13.

Figure 14:
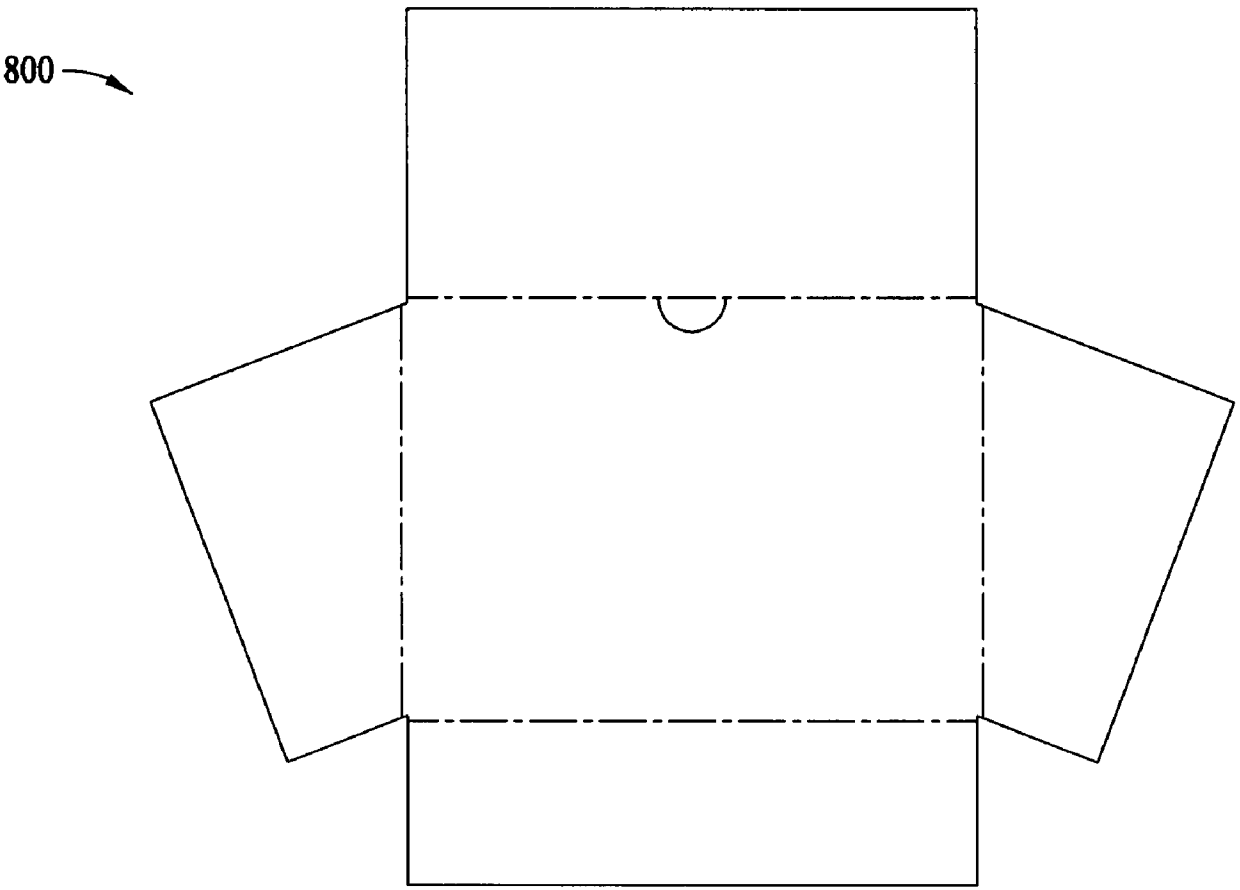
FIG. 14 is a plan view for a blank for an inner flow prompting ramp, to be used in combination with the outer shell according to the blank of FIG. 12.

FIG. 14 illustrates blank 800 for an alternative embodiment of an inner flow prompting ramp, for use with either of blanks 600 or 700 of FIG. 12 or 13, wherein use of the sidewall apertures is desired. Blank 800 provides for the sloping of the top panel of the ramp from one long edge to the other (i.e., from side to side, instead of front to back).

Figure 15:
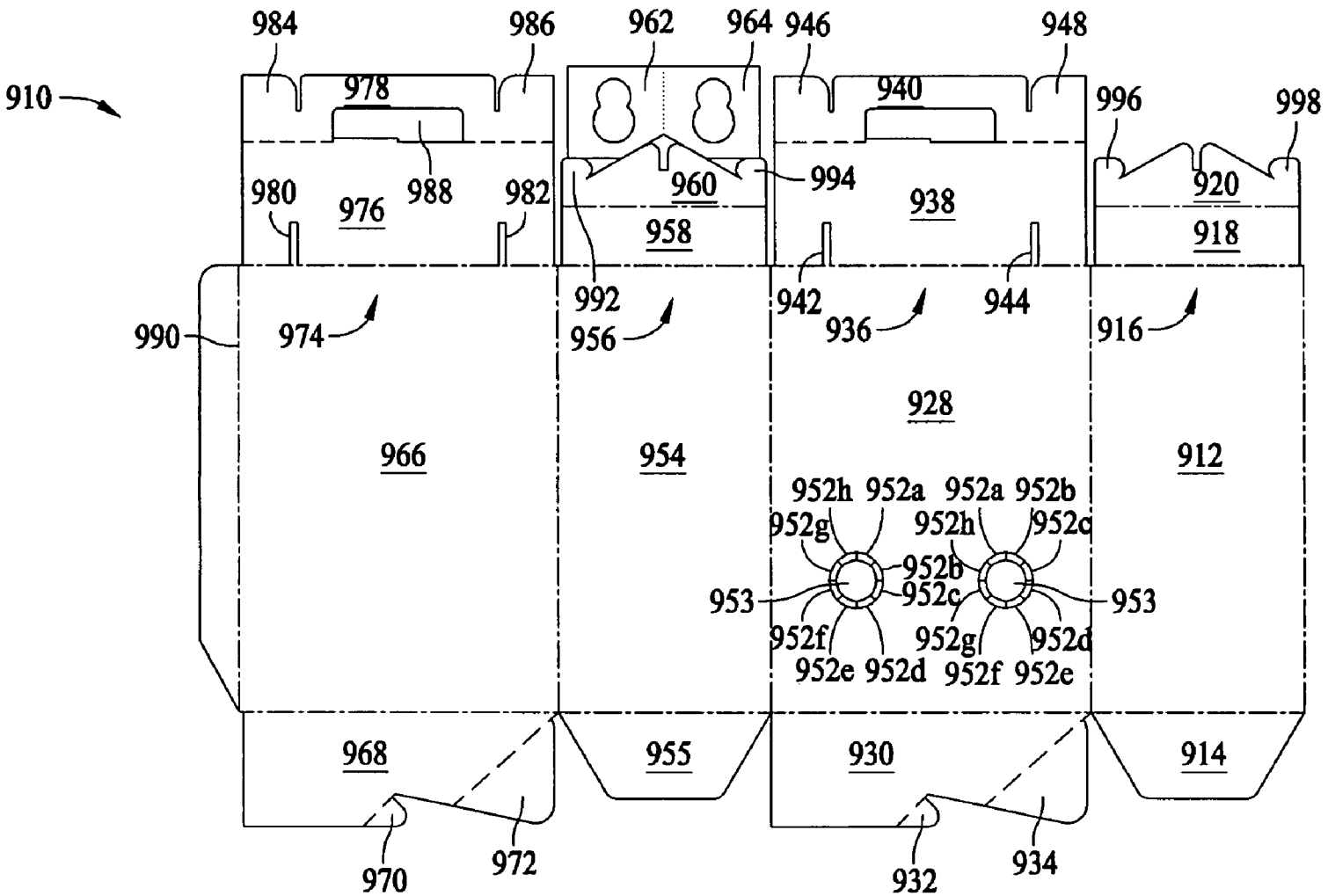
FIG. 15 is a plan view for a blank for an outer shell for a bag-in-box beverage container having two spout apertures.

FIG. 15 is a plan view for a blank 910 for an outer shell for a bag-in-box beverage container having at least two spout apertures. Blank 910 includes front panel 912, a front panel bottom flap 914, and a front panel handle flap 916, which in turn includes panels 918 and 920. Blank 910 also includes a first side panel 928 (foldably connected to front panel 912), a first side panel bottom flap 930 with scored tabs 932, 934, and a first side panel handle flap 936, including panels 938, 940, with slots 942, 944, and notches 946, 948, and die cut push out flap 950. Spout apertures 951 are defined by cut flaps 952*a*-952*h* and central apertures 953. A rear panel 954 is foldably connected to first side panel 928. A rear panel bottom flap 955 emanates from rear panel 954, as does rear panel handle flap 956, which includes, in turn, panels 958 and 960. Frangibly attached to panel 960 are foldably connected spout locking tabs 962, 964, each having keyhole shaped apertures therein. A second side panel 966 is foldably connected to rear panel 954. A second side panel bottom flap 968 emanates from second side panel 966, and includes foldably connected tabs 970, 972. A second side panel handle flap 974 includes panels 976, 978, slots 980, 982, notches 984, 986 and opening 988. A glue flap 990 is provided, which is affixed to an outside or inside surface of front panel 912. Panels 960 and 920 further include tabs 992, 994 and 996, 998, respectively.

To form the outer shell of the bag-in-box beverage container of the present invention, when blank 910 is formed into a tube by gluing flap 990 to front panel 912, front panel bottom flap 914, first side panel bottom flap 930, rear panel bottom flap 955 and second side panel bottom flap 968 are folded inwardly, and upwardly of the bottom edges of front panel 912, first side panel 928, rear panel 954 and second side panel 966. Tabs 972 and 934 are glued to adjacent panels 955 and 914, respectively. When set up, opposing flaps 968 and 930 are interlocked at the notches formed between tabs 932, 934 and 920, 972, respectively. Tabs 932, 970 are on the "inside" facing the interior of the resulting shell structure.

Figure 16:
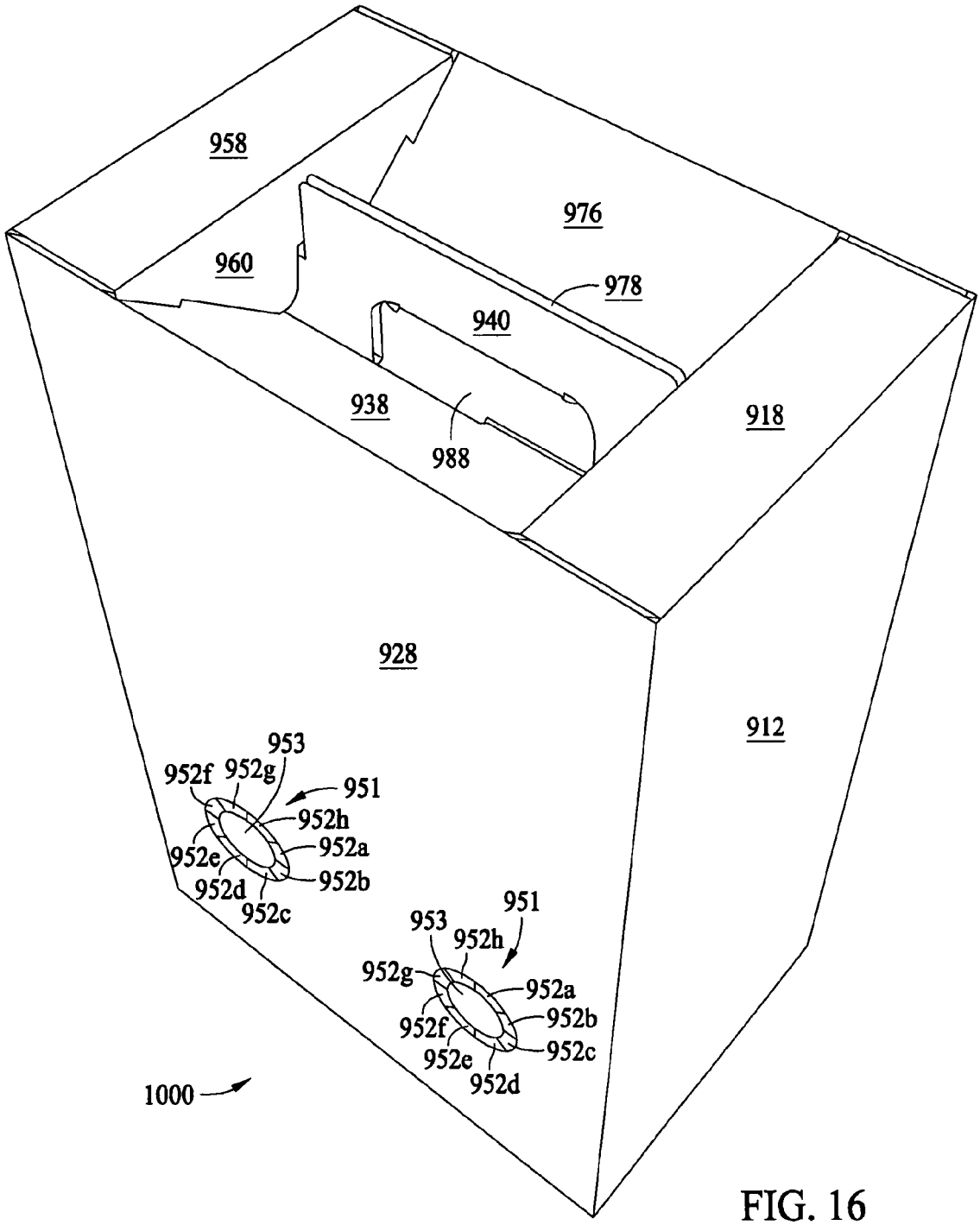
FIG. 16 is a perspective view of the bag-in-box beverage container having two spout apertures and formed from the blank shown in FIG. 15.

FIG. 16 is a perspective view of a bag-in-box beverage container 1000 having at least two spout apertures and formed from blank 910 (shown in FIG. 15). Bag-in-box beverage container 1000 includes front panel 912 and top handle flap 916. Bag-in-box beverage container 1000 also includes first side panel 928 (foldably connected to front panel 912), and side panel handle flap 936, including panels 938 and 940. Spout apertures 951 are defined by cut flaps 952*a*-952*h* and central aperture 953. Rear panel 954 (seen in FIG. 15) is foldably connected to first side panel 928. Rear panel handle flap 956 emanates from the rear panel. Second side panel 966 (as seen in FIG. 15) is foldably connected to the rear panel. Second side panel handle flap 974 emanates from the second side panel and includes panels 976 and 978.

To form the bag-in-box beverage container of the present invention, first side panel, front panel, second side panel, and rear panel are folded into a tubular shaped and glued together via a glue flap (not shown). When set up panels 918, 920, 938, 940, 958, 960, 976, and 978 are folded inward and connected using tabs and slots (see FIG. 15) to construct the top panel of the bag-in-box beverage container. The panels are folded such that a handle is formed which rests below the upper portion of the bag-in-box beverage container 1000. When fully erected, bag-in-box beverage container 1000 is configured to retain two beverage bags, wherein each bag is connected in flow communication with a spout extending through one of the spout apertures.

In another embodiment, bag-in-box beverage container 1000 is configured to have a plurality of compartments wherein each compartment includes a ramp, and a beverage bag.

Figure 17:
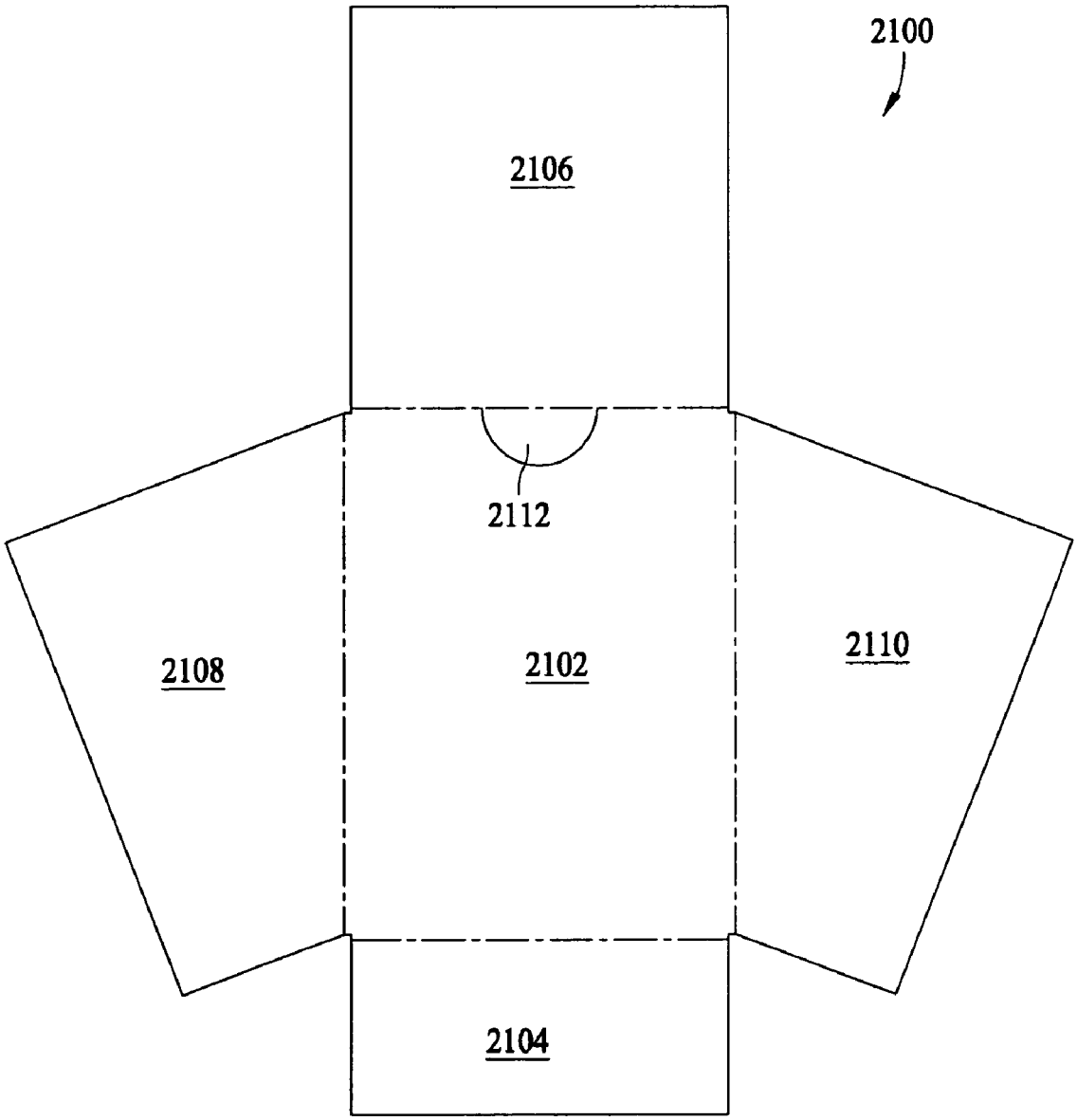
FIG. 17 is a plan view for the blank of an inner flow prompting ramp, for insertion into the outer shell of the bag-in-box beverage container shown in FIG. 16.
Figure 18:
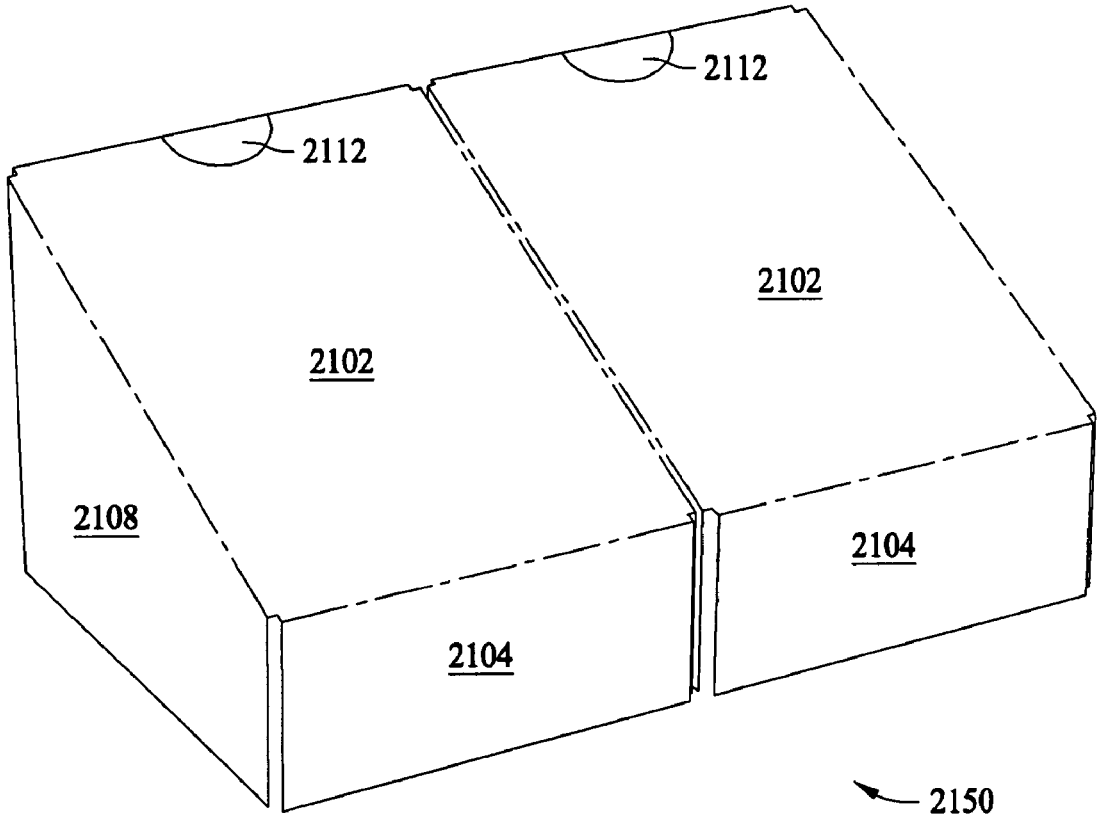
FIG. 18 is a perspective view of two inner flow prompting ramps assembled for insertion into a bag-in-box container shown in FIG. 16.

Because the interior liquid holding structure is a non-self-supporting flexible bag, a structure is required to prompt the liquid to flow toward the spout (see FIG. 18). To form the flow prompting structure, inner flow prompting ramps are formed from blank 2100 as illustrated in FIG. 17. Blank 2100 includes inclined panel 2102, short front panel 2104 (which has a height approximately equal to the distance between the bottom edge of first side panel 928 and the lower periphery of spout aperture 951, tall rear panel 2106, and trapezoidal side panels 2108, 2110, all of which will be folded to be parallel to respective first side panel 928, second side panel 966, rear panel 954, and front panel 912, respectively, upon insertion of the inner flow prompting ramp into the top opening of the shell (see FIG. 19). Finger notch 2112 is provided, to facilitate removal and/or replacement of the inner flow prompting ramp formed from blank 2100, during assembly and knockdown of the beverage container.

FIG. 18 is a view of inner flow prompting ramp 2150 assembled from blank 2100 for insertion into a bag-in-box beverage container of FIG. 15.

Figure 19:
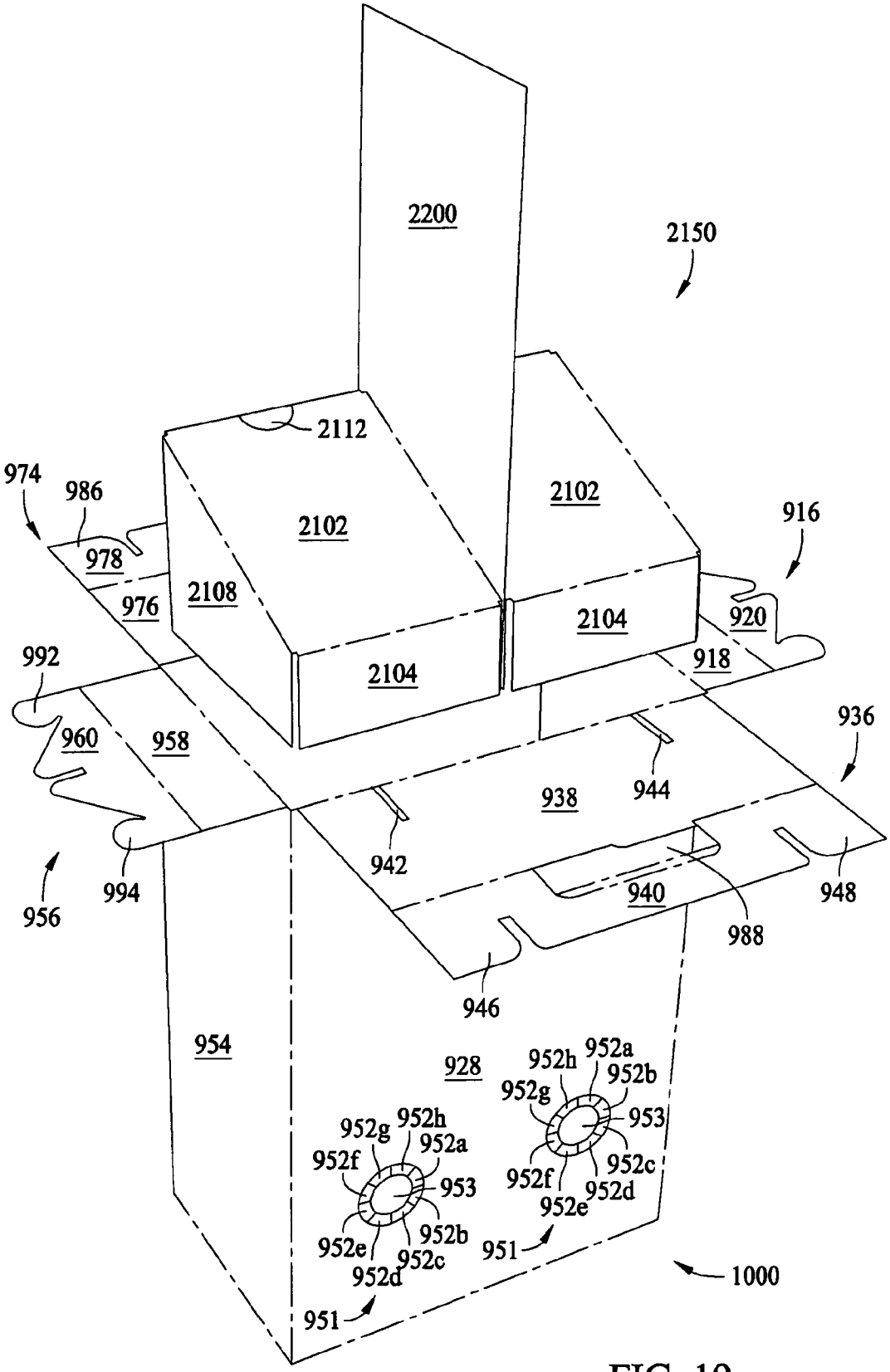
FIG. 19 is a perspective view of two inner flow prompting ramps being inserted into the bag-in-box beverage container of FIG. 16.
Figure 20:
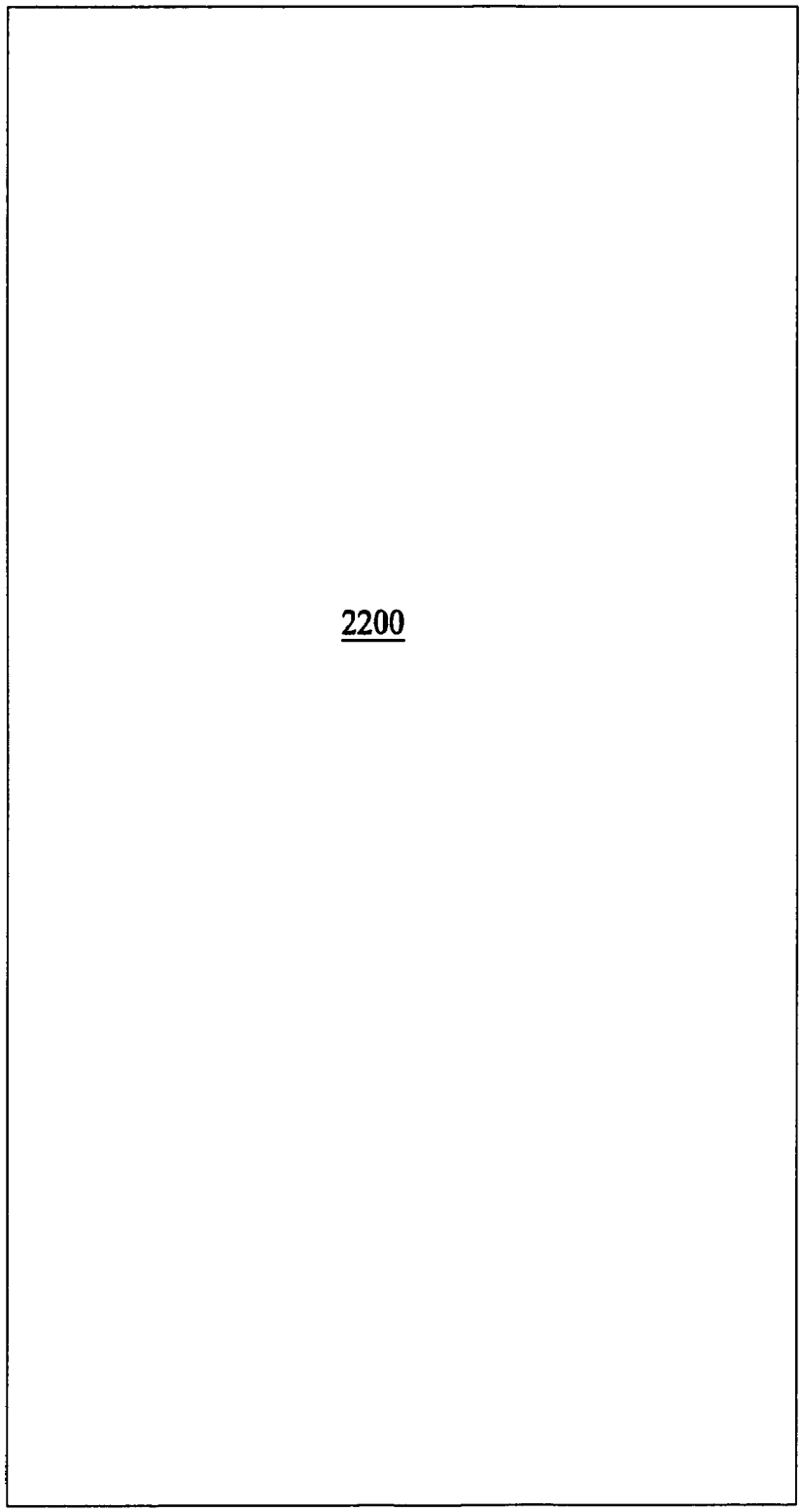
FIG. 20 is a view of an insulating panel inserted to divide the bag-in-box beverage container of FIG. 16 into at least two sections.
Figure 21:
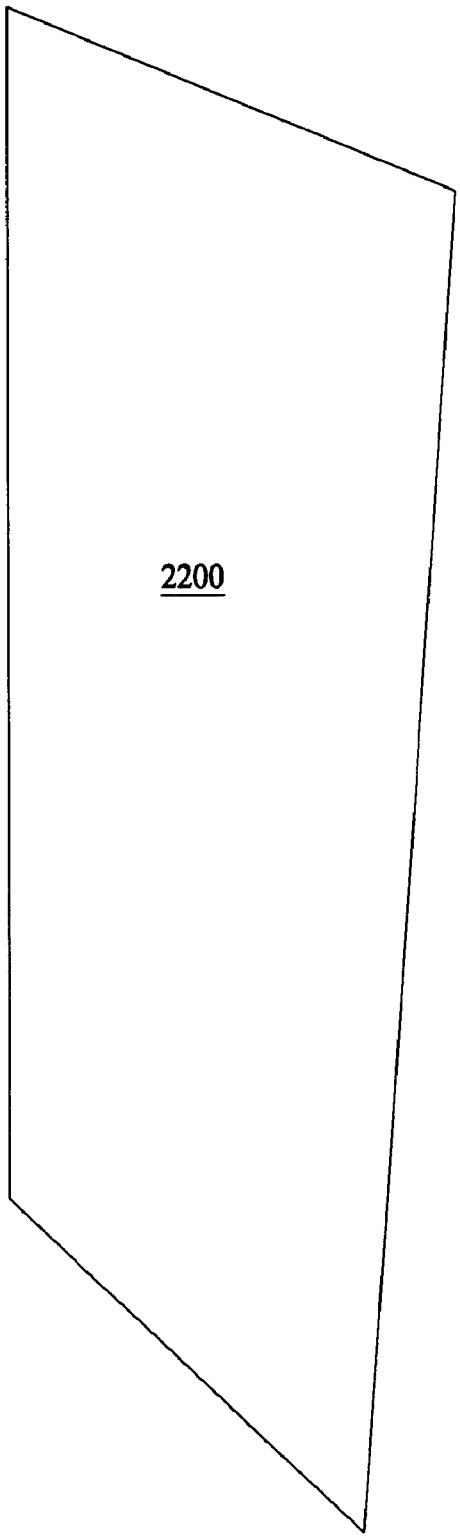
FIG. 21 is an angled view of the insulating panel shown in FIG. 20.

FIG. 19 is a view of two inner flow prompting ramps being inserted into the bag-in-box beverage container of FIG. 15. An insulating panel 2200 is inserted into beverage container 1000 such that it rests substantially flush between side panels 2108 and 2110 of the two inner flow prompting ramps. Insulating panel 2200 is substantially rectangular and has a depth substantially equal to the depth of the beverage container 1000 (See FIGS. 20-21). Insulating panel 2200 further rests within the vertical axis of beverage container 1000 and has a height such that it extends from a bottom panel (not shown) of the beverage container 1000 to handle flaps 940 and 978 (when the beverage container is closed).

Insulating panel 2200 divides the beverage container 1000 into two sections such that two beverage bags can be received therein. When the beverage bags are inserted, inner flow prompting ramps 2150 direct fluid in the bags towards spouts attached to the bags and inserted through apertures 951. Insulating panel 2200 further allows the two bags to contain fluent material and facilitates reducing heat transfer between the two bags such that the temperature of the fluent material in each bag is better maintained.

After the inner flow prompting ramp 2150 and beverage bags are inserted, beverage container 1000 can be closed by folding panels 916, 936, 956, and 974 inward. Tabs 946, and 948 are interlocked with tabs 984 and 986 (See FIG. 15) to create the handle portion of beverage container 1000. Tabs 992, 994, 996, and 998 are configured to be received through slots 982, 942, 944 and 980 (See FIG. 15) such that tab 992 is received in slot 982, tab 994 is received in slot 942, tab 996 is received in slot 944, and tab 998 is received in slot 980. The insertion of these tabs completes the closure of beverage container 1000.

The foregoing description and drawings merely explain and illustrate the invention and the invention is not limited thereto, as those skilled in the art who have the disclosure before them will be able to make modifications and variations therein without departing from the scope of the invention.

What is claimed is:

1. A dispensing container, operably configured to be positioned upon a substantially flat, horizontal surface, for the facilitated dispensing of fluent material, the dispensing container comprising:

a generally tubular body comprising a front wall, a rear wall and two opposing sidewalls, the generally tubular body defining a vertical axis extending substantially parallel with the front wall, a depth axis extending substantially perpendicular to the front wall, and a transverse axis extending substantially parallel with the front wall and substantially perpendicular to the vertical axis, the generally tubular body further comprising an upper portion forming an upper opening;

a closure structure disposed proximate the upper opening, the closure structure comprising a handle structure, the handle structure positioned substantially parallel with the depth axis in a recessed position within the upper opening and extending substantially parallel with the vertical axis no higher than an upper edge of the generally tubular body;

a plurality of spout apertures operably disposed in one of the sidewalls;

at least one inner flow prompting ramp operably positioned within the generally tubular body, the at least one inner flow prompting ramp comprising a lower end disposed adjacent the sidewall of the generally tubular body in which the plurality of spout apertures are disposed, a higher end disposed adjacent a sidewall opposite the sidewall having the lower end adjacent thereto, and an inclined surface extending between the lower end and the higher end, the lower end of the at least one inner flow prompting ramp being disposed at a distance above a bottom of the generally tubular body approximately equal to a distance between the bottom of the generally tubular body and a bottom peripheral region of the plurality of spout apertures, wherein the at least one inner flow ramp is formed from a separate second blank of foldable material insertably received into the generally tubular body, the second blank being a substantially cruciform blank comprising:

a central rectangular panel;

rectangular panels emanating from front and rear edge regions of the central panel;

trapezoidal panels emanating from side edges of the central panel; and foldable support panels emanating from side edges of the panels emanating from the front and rear edge regions of the central panel; and the generally tubular body being formed from a first blank of at least one of paper, paperboard, and corrugated paperboard.

2. The dispensing container according to claim 1 further comprising at least one insulating panel positioned within the generally tubular body and extending substantially parallel to the front wall of the generally tubular body.

3. The dispensing container according to claim 2 wherein the at least one insulating panel is positioned between a pair of adjacent inner flow prompting ramps.

4. The dispensing container according to claim 1, wherein the rear wall is disposed parallel to the front wall, and the two sidewalls are disposed parallel to one another and perpendicular to the front wall and the rear wall and extending therebetween.

5. The dispensing container according to claim 4, wherein the closure structure comprises:

first and second foldable sidewall top flaps emanating from top edge regions of the sidewalls, each of the first and second foldable sidewall top flaps comprising a first panel foldably connected to one of the sidewalls and positioned at an acute included angle relative thereto, each of the first and second foldable sidewall top flaps comprising a second panel foldably connected to one of the first panels, each of the second panels being folded upwardly into parallel orientation to the sidewalls and in juxtaposed overlying relation to one another, the second panels comprising top edges that are disposed no higher than the upper edge of the generally tubular body;

a foldable front wall top flap emanating from atop edge region of the front wall; and a foldable rear wall top flap emanating from a top edge region of the rear wall, the foldable front and rear wall top flaps each comprising first panels foldably connected to the front and rear walls, respectively, and positioned substantially perpendicular thereto, and the foldable front and rear wall top flaps each further comprising second panels foldably connected to the respective first panels of the front and rear wall top flaps and emanating downwardly therefrom, the second panels of the front and rear wall top flaps being disposed in positions interengaging with the second panels of the first and second sidewall top flaps to preclude undesired dislodgement of the second panels of the first and second sidewall top flaps.

6. The dispensing container according to claim 5 wherein the closure structure further comprises:

at least one slot in each of the second panels of the first and second sidewall top flaps; and at least one hooked tab emanating from each of the second panels of the front and rear wall top flaps, said hooked tabs being configured to be engagingly received in the slots when the second panels of the front and rear wall top flaps are folded over into interengagement with the second panels of the first and second sidewall top flaps.

7. The dispensing container according to claim 5 wherein the closure structure further comprises:

at least one notch in each of the second panels of the first and second sidewall top flaps, the notches being aligned with one another when the second panels of the first and second sidewall top flaps are parallel to the sidewalls and in juxtaposed overlying relation to one another; and a notch in at least one of the front and rear wall top flaps which is operably configured to interengage with the aligned notches in the second panels of the first and second sidewall top flaps when the second panels of the front and rear wall top flaps are folded over into interengagement with the second panels of the first and second sidewall top flaps.

8. The dispensing structure according to claim 5, wherein the handle structure comprises:

a hand opening aperture disposed in one of the second panels of the first and second sidewall top flaps;

a hingedly connected push-out flap disposed in the other of the second panels of the first and second sidewall top flaps, the push-out flap comprising a peripheral contour substantially conforming to the peripheral contour of the hand opening aperture, the push-out flap being configured to be pushed through the hand opening aperture and upwardly relative thereto to provide a grasping opening.

9. The dispensing container according to claim 1, wherein the second blank is fabricated from at least one of paper, paperboard, and corrugated paperboard.

10. The dispensing container according to claim 1, further comprising:

front and rear wall bottom flaps connected to bottom edge regions of the front and rear walls, respectively;

first and second sidewall bottom flaps connected to bottom edge regions of the first and second sidewalls, respectively;

each of the first and second sidewall bottom flaps including a pivotable engagement flap affixed to an outside surface of one of the front and rear bottom wall flaps; and the generally tubular body being operably configured to enable the closure structure to be opened and closed, when the closure structure is open, the generally tubular body is articulatable between a collapsed configuration, in which the front wall and one sidewall are disposed in juxtaposed overlying adjacent orientation to the other sidewall and the rear wall, with the front and rear wall bottom flaps being folded up inside a bottom opening region of the generally tubular body, in juxtaposed relation to inside bottom surfaces of the front and rear walls, respectively, and the respective pivotable engagement flaps are folded back upon their respective first and second sidewall bottom flaps, and an articulated position, wherein the front and rear walls are parallel to each other and perpendicular to the sidewalls, whereupon articulation from the collapsed configuration, the first and second sidewall bottom flaps and their respective attached front and rear wall bottom panels are automatically prompted to move into partial overlapping relation to the front and rear wall bottom flaps to define a bottom for the articulated dispensing container.

11. The dispensing container according to claim 10, wherein the first and second sidewall bottom flaps each further comprise engagement tabs that interlock, upon articulation, to maintain the first and second sidewall bottom flaps and the front and rear bottom flaps in their partially overlapping, bottom defining orientation.

12. The dispensing container according to claim 1, further comprising:

a plurality of inner bags operably configured for containing a liquid; and a spout structure operably associated with each bag, the spout structure configured to be passed through one of the plurality of spout apertures upon placement of each inner bag within the generally tubular body.

13. The dispensing container according to claim 12, further comprising a dispensing spigot operably configured to be positioned on each of the plurality of spout structures after passage of each spout structure through one of the plurality of spout apertures of the generally tubular body.

14. The dispensing container according to claim 12, further comprising at least one locking member operably configured for engaging each of the plurality of spout structures after placement of each spout structure through one of the plurality of spout apertures of the generally tubular body, the at least one locking member configured to preclude removal of the plurality of spout structures from the plurality of spout apertures.

15. The dispensing container according to claim 1, further comprising at least one further spout aperture operably disposed in one of the plurality of sidewalls adjacent the lower end of the at least one inner flow prompting ramp.

16. A dispensing container for the facilitated dispensing of fluent material, said dispensing container comprising:

a body comprising a front wall, a back wall and two opposing sidewalls, the body defining a vertical axis extending substantially parallel with the front wall, a depth axis extending substantially perpendicular to the front wall, and a transverse axis extending substantially parallel with the front wall and substantially perpendicular to the vertical axis, the body further comprising an upper portion including an upper opening and an upper edge;

a closure structure disposed proximate the upper opening, said closure structure including a handle structure positioned substantially parallel with the depth axis in a recessed position within the upper opening and extending substantially parallel with the vertical axis no higher than the upper edge;

a plurality of spout apertures operably disposed in one sidewall of the two opposing sidewalls; and an inner flow ramp formed from a separate second blank of foldable material insertably received into the body, the second blank being a substantially cruciform blank comprising:

a central rectangular panel;

rectangular panels emanating from front and rear edge regions of the central panel;

trapezoidal panels emanating from side edges of the central panel; and interlocking bottom panels emanating from side edge regions of the trapezoidal panels.

17. A dispensing container, operably configured to be positioned upon a substantially flat, horizontal surface, for the facilitated dispensing of fluent material, the dispensing container comprising:

a generally tubular body comprising a front wall, a rear wall, and two opposing sidewalls, the generally tubular body defining a vertical axis extending substantially parallel with the front wall, a depth axis extending substantially perpendicular to the front wall, and a transverse axis extending substantially parallel with the front wall and substantially perpendicular to the vertical axis, the generally tubular body further comprising an upper portion forming an upper opening;

a closure structure disposed proximate the upper opening, the closure structure comprising a handle structure, the handle structure positioned substantially parallel with the depth axis in a recessed position within the upper opening and extending substantially parallel with the vertical axis no higher than an upper edge of the generally tubular body;

a plurality of spout apertures operably disposed in one of the sidewalls; and at least one inner flow prompting ramp operably positioned within the generally tubular body, the at least one inner flow prompting ramp comprising a lower end disposed adjacent the sidewall of the generally tubular body in which the plurality of spout apertures are disposed, a higher end disposed adjacent a sidewall opposite the sidewall having the lower end adjacent thereto, and an inclined surface extending between the lower end and the higher end, the lower end of the at least one inner flow prompting ramp being disposed at a distance above a bottom of the generally tubular body approximately equal to a distance between the bottom of the generally tubular body and a bottom peripheral region of the plurality of spout apertures, wherein the inner flow ramp is formed from a separate second blank of foldable material, insertably received into the generally tubular body, the second blank being a substantially cruciform blank comprising:

a central rectangular panel;

rectangular panels emanating from front and rear edge regions of the central panel;

trapezoidal panels emanating from side edges of the central panel; and inwardly folding triangular gusset panel pairs foldably connecting side edge regions of the rectangular panels emanating from the front and rear edge regions of the central panel to end edge regions of the trapezoidal panels emanating from the side edge regions of the central panel; and wherein the generally tubular body is formed from a first blank of at least one of paper, paperboard, and corrugated paperboard.

18. A dispensing container, operably configured to be positioned upon a substantially flat, horizontal surface, for the facilitated dispensing of fluent material, the dispensing container comprising:

a generally tubular body comprising a front wall, a rear wall, and two opposing sidewalls, the generally tubular body defining a vertical axis extending substantially parallel with the front wall, a depth axis extending substantially perpendicular to the front wall, and a transverse axis extending substantially parallel with the front wall and substantially perpendicular to the vertical axis, the generally tubular body further comprising an upper portion forming an upper opening;

a closure structure disposed proximate the upper opening, the closure structure comprising a handle structure, the handle structure positioned substantially parallel with the depth axis in a recessed position within the upper opening and extending substantially parallel with the vertical axis no higher than an upper edge of the generally tubular body;

a plurality of spout apertures operably disposed in one of the sidewalls;

at least one inner flow prompting ramp operably positioned within the generally tubular body, the at least one inner flow prompting ramp comprising a lower end disposed adjacent the sidewall of the generally tubular body in which the plurality of spout apertures are disposed, a higher end disposed adjacent a sidewall opposite the sidewall having the lower end adjacent thereto, and an inclined surface extending between the lower end and the higher end, the lower end of the at least one inner flow prompting ramp being disposed at a distance above a bottom of the generally tubular body approximately equal to a distance between the bottom of the generally tubular body and a bottom peripheral region of the plurality of spout apertures, wherein the at least one inner flow prompting ramp is formed from a separate second blank of foldable material, which is insertably received into the general tubular body, the second blank comprising:

a central rectangular panel;

trapezoidal side panels emanating from outside edges of the central panel;

rectangular bottom panels emanating from outside edges of the trapezoidal side panels;

center support panels emanating from outside edges of the rectangular bottom panels;

inside inclined planes emanating from outside edges of the center support panels; and a pivotable interlocking tab disposed in one of the rectangular bottom panels and an aperture disposed in the other of the rectangular bottom panels for receiving the pivotable interlocking tab, the interlocking tab and the aperture configured to maintain the blank in its articulated configuration, wherein the ramp is formed upon successive inward folding of the outermost ones of the panels such that the trapezoidal side panels are folded perpendicular to the central rectangular panel, the rectangular bottom panels are folded perpendicular to the trapezoidal side panels, the center support panels are folded perpendicular to the rectangular bottom panels, and the inside inclined panels are folded perpendicular to the center support panels and in underlying parallel juxtaposed relation to the central rectangular panel; and wherein the generally tubular body is formed from a first blank of at least one of paper, paperboard, and corrugated paperboard.

* * * * *

UNITED STATES PATENT AND TRADEMARK OFFICE

CERTIFICATE OF CORRECTION

PATENT NO. : 7,571,835 B2
APPLICATION NO. : 11/318304
DATED : August 11, 2009
INVENTOR(S) : Hill et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 779 days.

Signed and Sealed this

Fourteenth Day of December, 2010

David J. Kappos

David J. Kappos
*Director of the United States Patent and Trademark Office*